US010451252B1

(12) United States Patent
Sayers et al.

(10) Patent No.: US 10,451,252 B1
(45) Date of Patent: Oct. 22, 2019

(54) LIGHT REDISTRIBUTION APPARATUS FOR LOW PROFILE WALL WASH LIGHT FIXTURES

(71) Applicant: Cooper Technologies Company, Houston, TX (US)

(72) Inventors: Wilston Nigel Christopher Sayers, Atlanta, GA (US); Kevin Roy Harpenau, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 85 days.

(21) Appl. No.: 15/680,810

(22) Filed: Aug. 18, 2017

Related U.S. Application Data

(60) Provisional application No. 62/378,530, filed on Aug. 23, 2016.

(51) Int. Cl.

| | |
|---|---|
| ***F21V 17/02*** | (2006.01) |
| ***F21S 8/02*** | (2006.01) |
| ***F21V 14/04*** | (2006.01) |
| ***F21V 7/04*** | (2006.01) |
| ***F21V 17/10*** | (2006.01) |
| ***F21V 7/22*** | (2018.01) |

(52) U.S. Cl.
CPC ..... *F21V 17/02* (2013.01); *F21S 8/026* (2013.01); *F21V 7/04* (2013.01); *F21V 7/22* (2013.01); *F21V 14/04* (2013.01); *F21V 17/101* (2013.01)

(58) Field of Classification Search
CPC ... F21S 9/02; F21S 8/026; F21V 11/02; F21V 21/04
See application file for complete search history.

(56) References Cited

U.S. PATENT DOCUMENTS

| | | | | |
|---|---|---|---|---|
| 4,384,318 | A * | 5/1983 | Reibling | F21S 6/003 362/216 |
| 5,483,428 | A | 1/1996 | Poppenheimer | |
| D383,564 | S | 9/1997 | Lecluze | |
| 5,662,403 | A * | 9/1997 | Akashi | F21S 8/02 362/292 |
| 6,417,966 | B1 * | 7/2002 | Moshrefzadeh | G03B 21/62 359/453 |
| D473,966 | S | 4/2003 | Lecluze | |
| 6,588,922 | B1 | 7/2003 | DeCicco | |
| D488,251 | S | 4/2004 | Benghozi | |
| 7,397,984 | B2 * | 7/2008 | Kuo | H04N 9/3141 348/E5.138 |

(Continued)

*Primary Examiner* — Peggy A Neils
(74) *Attorney, Agent, or Firm* — King & Spalding LLP

(57) ABSTRACT

A light fixture includes a housing that defines a first cavity. Further, the light fixture includes a light module that is disposed in the first cavity and is configured to emit light in a first direction. Furthermore, the light fixture includes a light redistribution apparatus that is coupled to the housing and is disposed in the first cavity to receive the light from the light module. The light redistribution apparatus includes an outer collar comprising a body that defines a second cavity. Further, the light redistribution apparatus includes a plurality of redirection segments that are disposed within the outer collar and across at least a portion of the second cavity such that they redirect a portion of the light that is emitted in the first direction towards a second direction and allow a remainder portion of the light to travel unobstructed towards the first direction.

19 Claims, 22 Drawing Sheets

(56) References Cited

U.S. PATENT DOCUMENTS

| | | | | |
|---|---|---|---|---|
| D595,452 | S | 6/2009 | Khang | |
| 7,568,818 | B2 * | 8/2009 | Pfund | F21S 8/033 362/303 |
| D615,239 | S | 5/2010 | Rashidi | |
| D636,925 | S | 4/2011 | Kawagoe | |
| D644,781 | S | 9/2011 | Kawagoe | |
| 8,201,956 | B2 * | 6/2012 | Yeh | F21V 9/14 362/19 |
| D670,855 | S | 11/2012 | Turner | |
| D671,668 | S | 11/2012 | Rowlette, Jr. | |
| 9,222,651 | B1 * | 12/2015 | Vlad | F21V 19/001 |
| 2004/0240211 | A1 | 12/2004 | Rodgers | |
| 2007/0121325 | A1 * | 5/2007 | Barber | F21V 11/02 362/290 |
| 2009/0052169 | A1 * | 2/2009 | Kosters | F21V 11/02 362/224 |
| 2009/0135608 | A1 | 5/2009 | Sell | |

* cited by examiner

LIGHT REDISTRIBUTION APPARATUS FOR LOW PROFILE WALL WASH LIGHT FIXTURES

RELATED APPLICATIONS

The present application claims priority under 35 U.S.C. § 119(e) to U.S. Provisional Patent Application No. 62/378,530, titled "Light Redistribution Apparatus for Low Profile Wall Wash Light Fixtures," and filed on Aug. 23, 2016. The entire contents of the foregoing application are hereby incorporated herein by reference.

TECHNICAL FIELD

Embodiments of the present disclosure relate generally to light fixtures, and more particularly to a light redistribution apparatus in low profile wall wash light fixtures.

BACKGROUND

Typical wall wash light fixtures, e.g., recessed wall wash downlights, include generally highly reflective, smooth, and tall vertical reflector kickers that are attached to a lower trim of the light fixtures to re-direct a uniform distribution of light onto a vertical wall. The height of the trim in the typical wall wash light fixtures allows for a tall enough reflector kicker to effectively illuminate a wall. However, such trims or light fixtures that are tall may not be suitable for installations in a shallow plenum space because of the space constraint. Instead, a shallow and/or wide trim (or shallow and/or wide light fixture) may be used. However, in the case of a shallow and/or wide trim, a single vertical reflector kicker (as in the case of a tall trim) may not re-direct enough light on a wall to be an effective wall wash. Therefore, there is a need for technology that produces an effective wall wash for wide and/or shallow recessed light fixtures or light fixtures having wide and/or shallow trims.

SUMMARY

In one aspect, the present disclosure relates to a light fixture that includes a housing that defines a first cavity. Further, the light fixture includes a light module that is disposed in the first cavity and is coupled to an inner surface of the housing. The light module is configured to emit light in a first direction. Furthermore, the light fixture includes a light redistribution apparatus that is coupled to a body of the housing and disposed in the first cavity such that it receives the light from the light module. The light redistribution apparatus includes an outer collar that includes a body that extends from a top edge toward a bottom edge and defines a second cavity. Furthermore, the light redistribution apparatus includes a plurality of redirection segments that are disposed within the outer collar and across at least a portion of the second cavity such that they redirect a portion of the light from the first direction toward a second direction.

In another aspect, the present disclosure relates to a light redistribution apparatus that includes an outer collar comprising a body that extends from a top edge toward a bottom edge and defines a cavity, and a plurality of redirection segments that are disposed within the outer collar and across at least a portion of the cavity such that a portion of light that is emitted by a light module in a first direction is redirected by the plurality of redirection segments toward a second direction while allowing a remainder portion of the light to pass unobstructed toward the first direction.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1A:
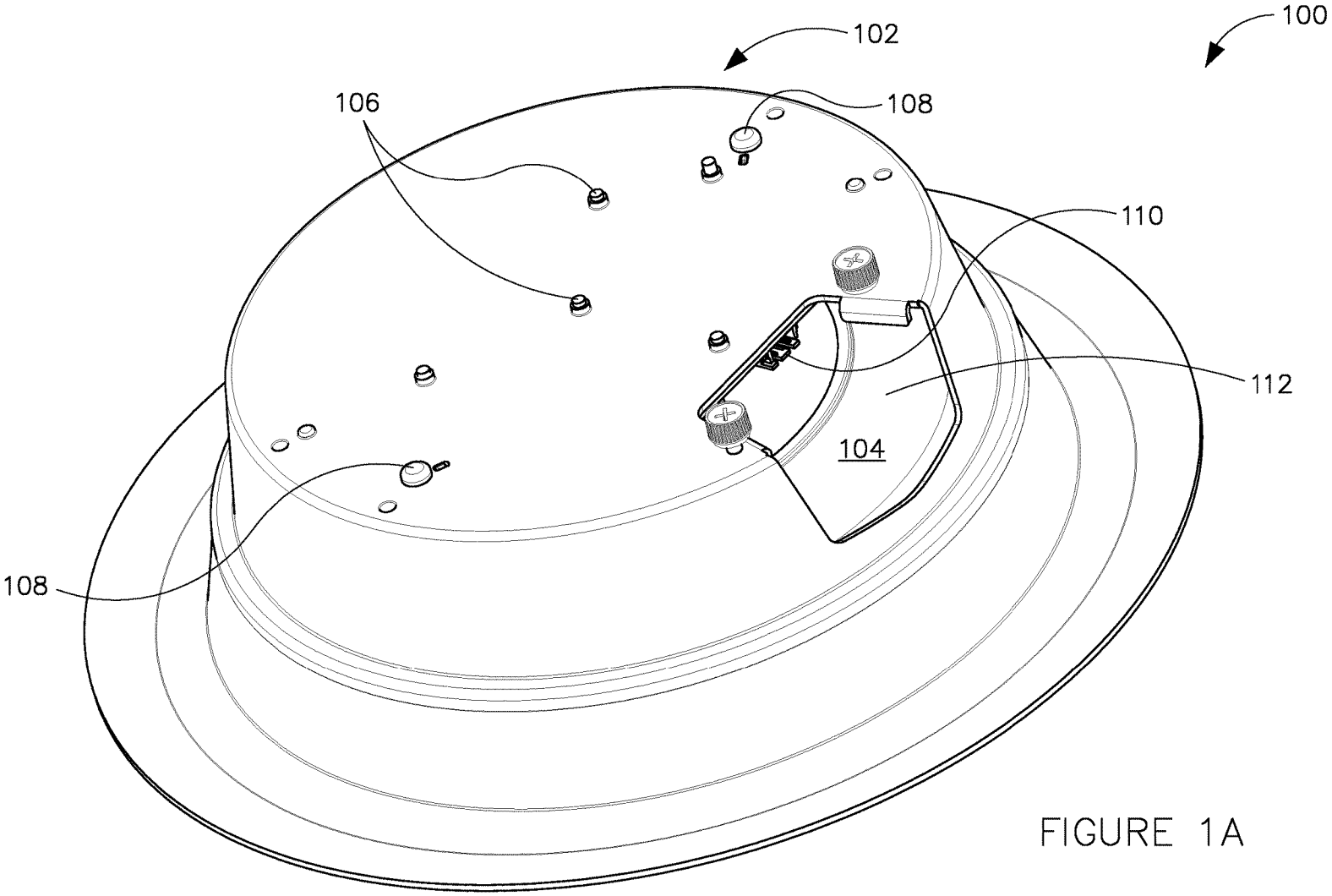
FIGS. 1A and 1B (collectively 'FIG. 1') illustrate a top perspective view and a bottom perspective view of a low profile wall wash recessed downlight with an example light redistribution apparatus, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positioning may be exaggerated to help visually convey such principles.

DETAILED DESCRIPTION

The present disclosure describes an example light redistribution apparatus that is configured for use with a low profile wall wash recessed downlight, e.g., a wide and/or shallow downlight (or a downlight with a wide and/or shallow trim). The example light redistribution apparatus includes a collar that defines an inner cavity through which light from a light source of the low profile wall wash recessed downlight exits. In certain examples, the collar may be ring shaped, however, in other example embodiments, the collar may have any other appropriate geometric or non-geometric shape without departing from a broader scope of the present disclosure. For example, for use in square light fixtures, the collar may be square shaped. Further, the light redistribution apparatus includes a plurality of angled reflector sections that are disposed within the collar, particularly, across the inner cavity defined by the collar. In other words, the plurality of angled reflector sections may be configured within the collar in a substantially louvered geometry. Adjacent pairs of the plurality of reflector sections may be spaced apart from each other. Further, the plurality of reflector sections may be of various heights and tilts, and furthermore, one or more surfaces of each reflector section may have a series of horizontally curved features, such as ripples disposed thereon to receive, redirect, and diffuse at least a portion of light exiting the low profile wall wash recessed downlight. Additionally, the light redistribution apparatus is rotatably coupled to the low profile wall wash recessed downlight to adjust a direction of the redistributed light as desired by a user.

In particular, the plurality of reflector sections may redistribute a portion of the light towards a vertical surface, e.g., vertical wall in a room that is desired to be illuminated. Further, the plurality of reflector sections may allow a remainder portion of light to pass through the space in between adjacent pairs of the plurality of reflector sections, without redirection, towards another area, e.g., an area below the downlight such as a corridor or any other portion of the room other than the vertical wall. In other words, the example light redistribution apparatus of the present disclosure is a low profile apparatus having a louvered geometry that is designed to redirect at least a portion of light from the low profile wall wash recessed downlight towards a vertical surface such that it uniformly illuminates the vertical surface via an asymmetric distribution of light, while also illuminating a corridor or an another area (e.g., below the downlight, horizontal surface, etc.) using a remainder portion of the light from the low profile wall wash recessed downlight.

The example redistribution apparatus for low profile wall wash light fixtures will be described below in greater detail in association with FIGS. 1-21. In particular, FIGS. 1-8 describe the low profile wall wash recessed downlight that houses the light redistribution apparatus; and FIGS. 9-21 describe different example light redistribution apparatuses.

Turning to FIGS. 1-8, the low profile wall wash recessed downlight 100 (herein 'downlight') may include a housing 102 that defines a cavity 193 that is configured to accommodate therein, a light module 302, a reflector 104, an outer support ring 702, and/or a light redistribution apparatus 190, 1502, or 2002. In particular, the housing 102 may include a substantially circular top surface 202, a ring shaped bottom flange 216, and a conical frustum shaped body 229 that extends between an inner annular edge 214 of the ring shaped bottom flange 216 and a perimeter of the top surface 202.

Even though the present disclosure describes a circular light fixture, one of ordinary skill in the art can understand and appreciate that in other example embodiments, the light fixture can have any other geometric or non-geometric shape without departing from a broader scope of the present disclosure. Further, in embodiments where the fixture has a non-circular shape, the bottom flange 216, the outer support ring 702, the inner annular edge 214, etc., may not be annular shaped. For example, in an embodiment with a square light fixture, the bottom flange 216, and the outer support ring 702, and the inner edge 214 may all be square shaped or shapes that align and fit with or are compatible with the square light fixture.

Figure 2:
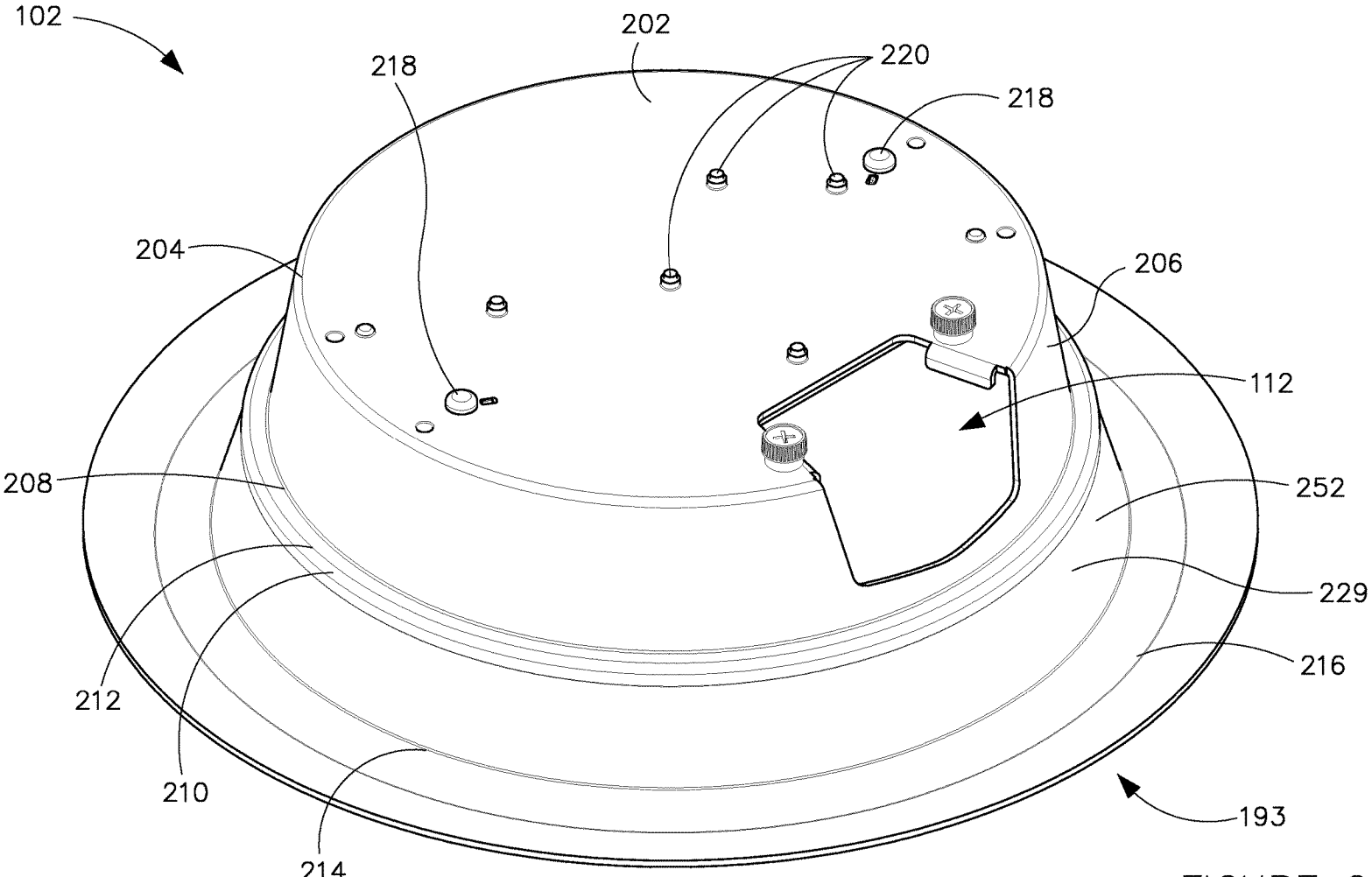
FIG. 2 illustrates a top perspective view of a housing of the low profile wall wash recessed downlight of FIG. 1, in accordance with example embodiments of the present disclosure.

As illustrated in FIG. 2, the body 229 may taper from the inner annular edge 214 of the ring shaped bottom flange 216 towards the annular edge 204 of the top surface 202. Further, the body 229 may be configured as multiple portions: a top portion 206 that extends downwards from the circular perimeter 204 of the top surface 202 towards an intermediate annular edge 208 that is disposed between the circular perimeter 204 of the top surface 202 and the inner annular edge 214 of the bottom flange 216, a lip 212 that extends radially outward from the intermediate annular edge 208 towards an outer annular edge 210, and a bottom portion 252 that extends downwards from an outer annular edge 210 of the lip 212 towards the inner annular edge 214 of the ring shaped bottom flange 216. However, in other example embodiments, the body 229 of the housing 102 may be configured in any other appropriate shape without departing from a broader scope of the present disclosure. For example, the housing body 229 may not taper or the housing body 229 may be smooth, i.e., may not include the lip 212, etc.

Figure 1B:
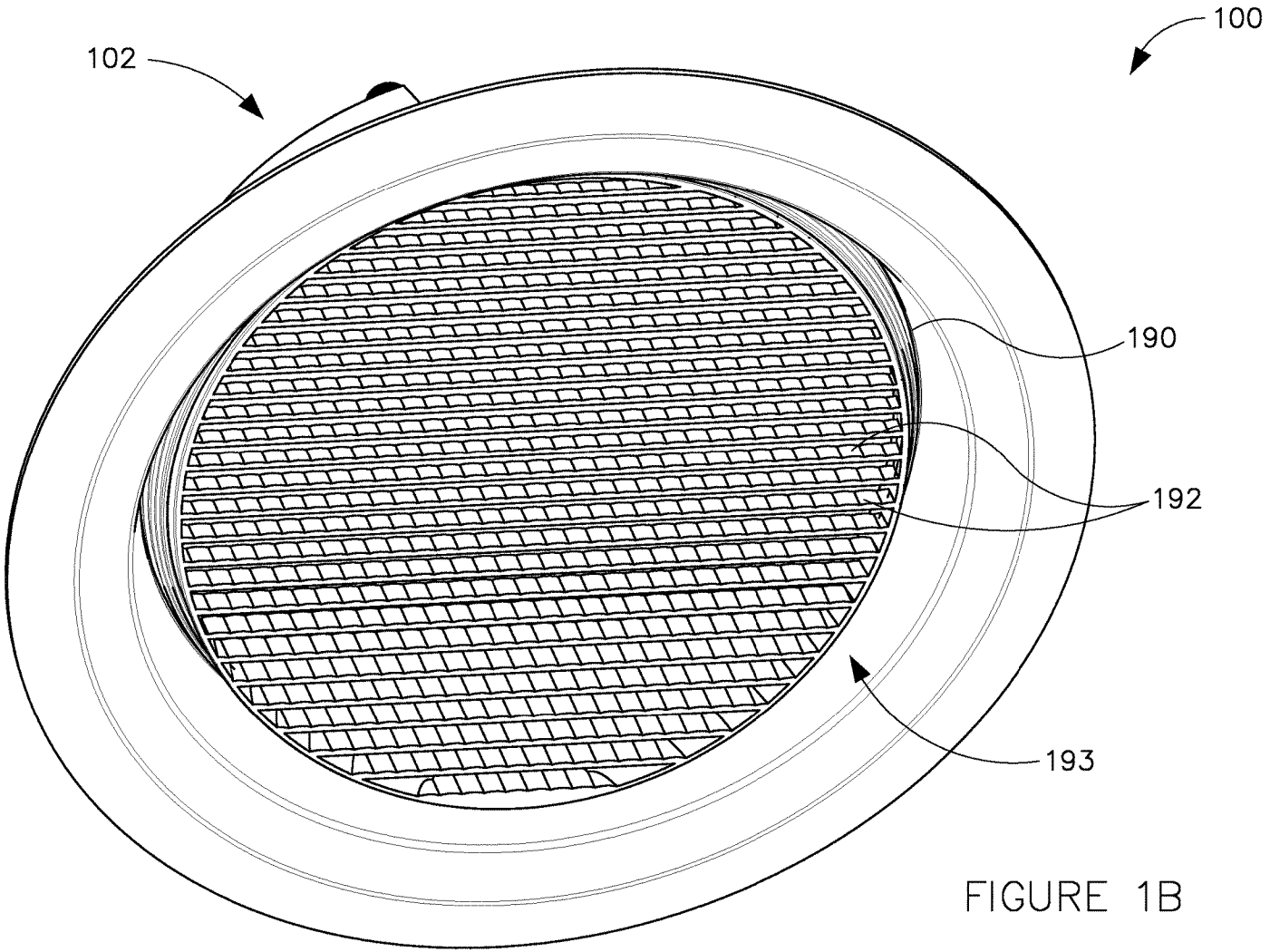

Furthermore, as illustrated in FIGS. 1 and 2, the housing 102 may include an opening 112 that spans a portion of the top surface 202 and the first portion 206 of the body 229. The opening 112 leads to and is in communication with the cavity 193 defined by the housing 102. Additionally, as illustrated in FIGS. 1, 2, 14, and 18, the top surface 202 of the housing 102 may include: (i) one or more first coupling apertures 220 that are configured to couple a light module 302 to the housing 102 using one or more fasteners 106, and (ii) one or more second coupling apertures 218 that are configured to couple a reflector 104 to the housing 102 using fasteners 108.

Figure 3:
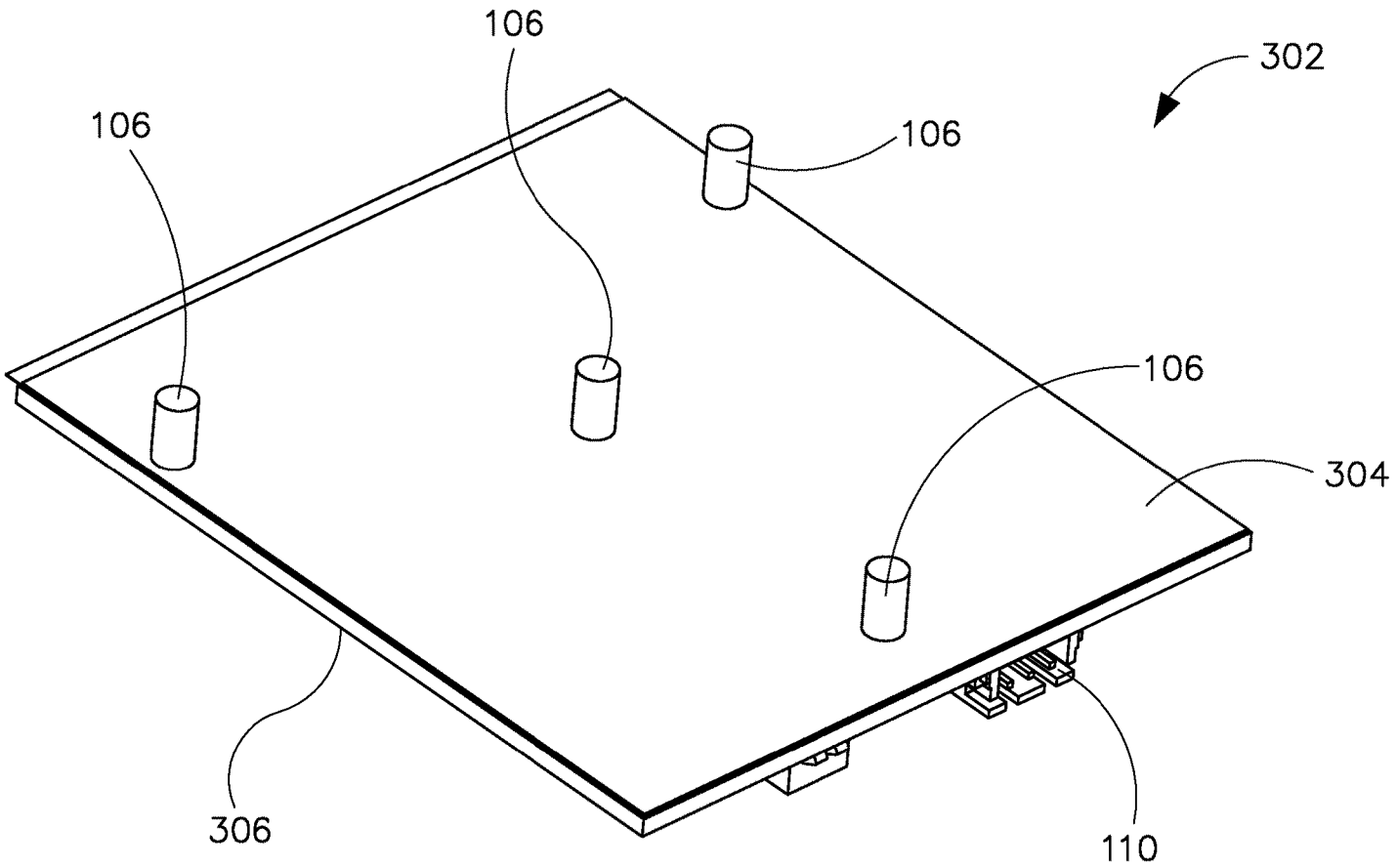
FIGS. 3 and 4 illustrate a top perspective view and a bottom perspective view of a light module of the low profile wall wash recessed downlight of FIG. 1, in accordance with example embodiments of the present disclosure.
Figure 4:
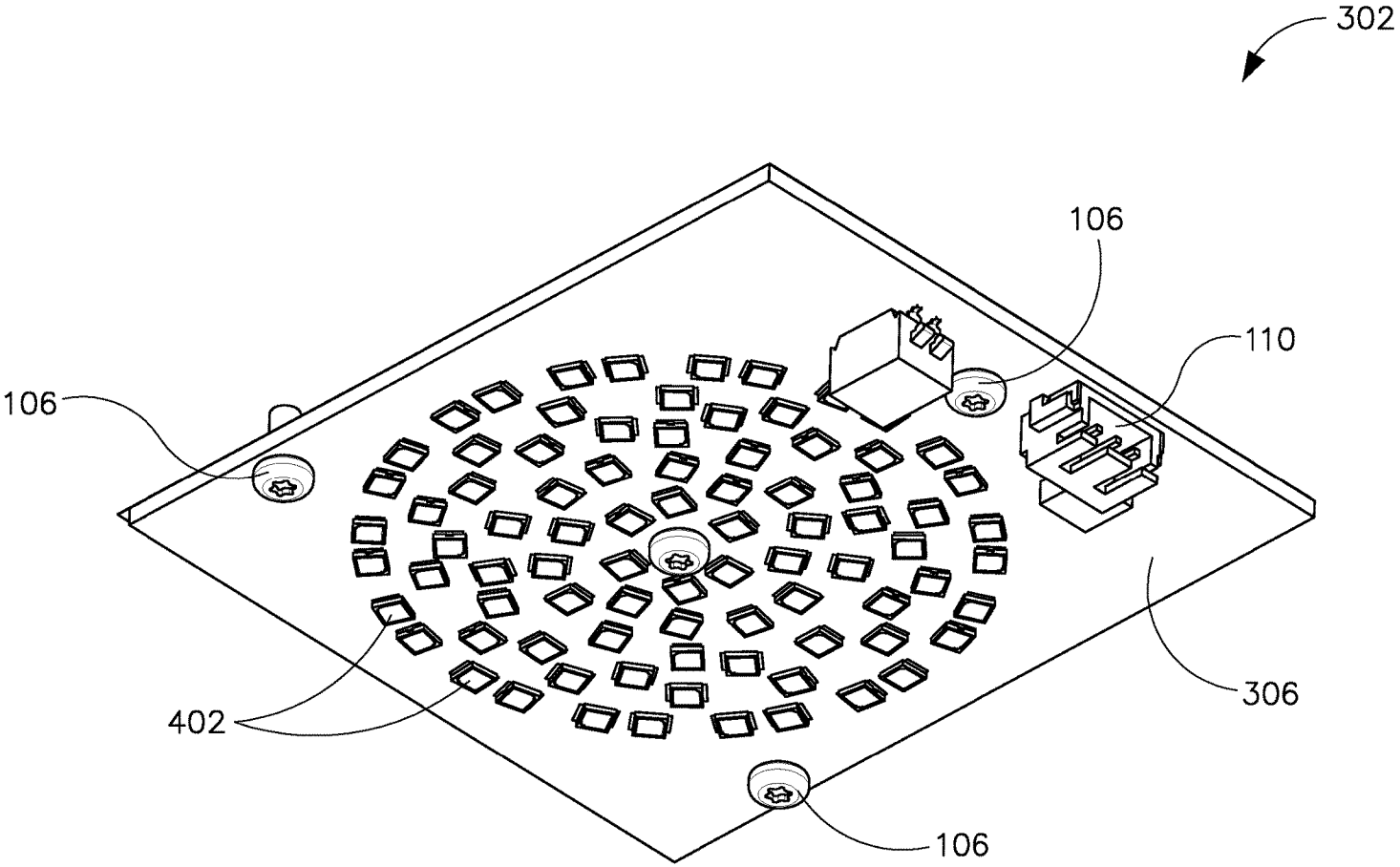

Turning to FIGS. 3 and 4, the light module 302 of the downlight 100 includes a circuit board 306, one or more light sources 402 disposed on a front surface of the circuit board 306, and a reflective panel 304 disposed on a back surface of the circuit board 306 to reflect light towards the front surface of the circuit board 306. In some example embodiments, the reflective panel 304 may be an adhesive panel that is configured to attach the light module 302 to the housing 102. However, in other example embodiments, in addition to or instead of using adhesives, the light module 302 may be coupled to the housing 102 using one or more fasteners 106. In particular, the circuit board 306 may include one or more through holes that are configured to receive the fasteners 106 therethrough for coupling the light module 302 to the housing 102. The one or more through holes of the light module 302 may be positioned such that they align with the one or more first coupling apertures 220 of the housing 102 to receive the fasteners 106 therethrough for coupling the light module 302 to the top surface 202 of the housing 102.

Figure 14:
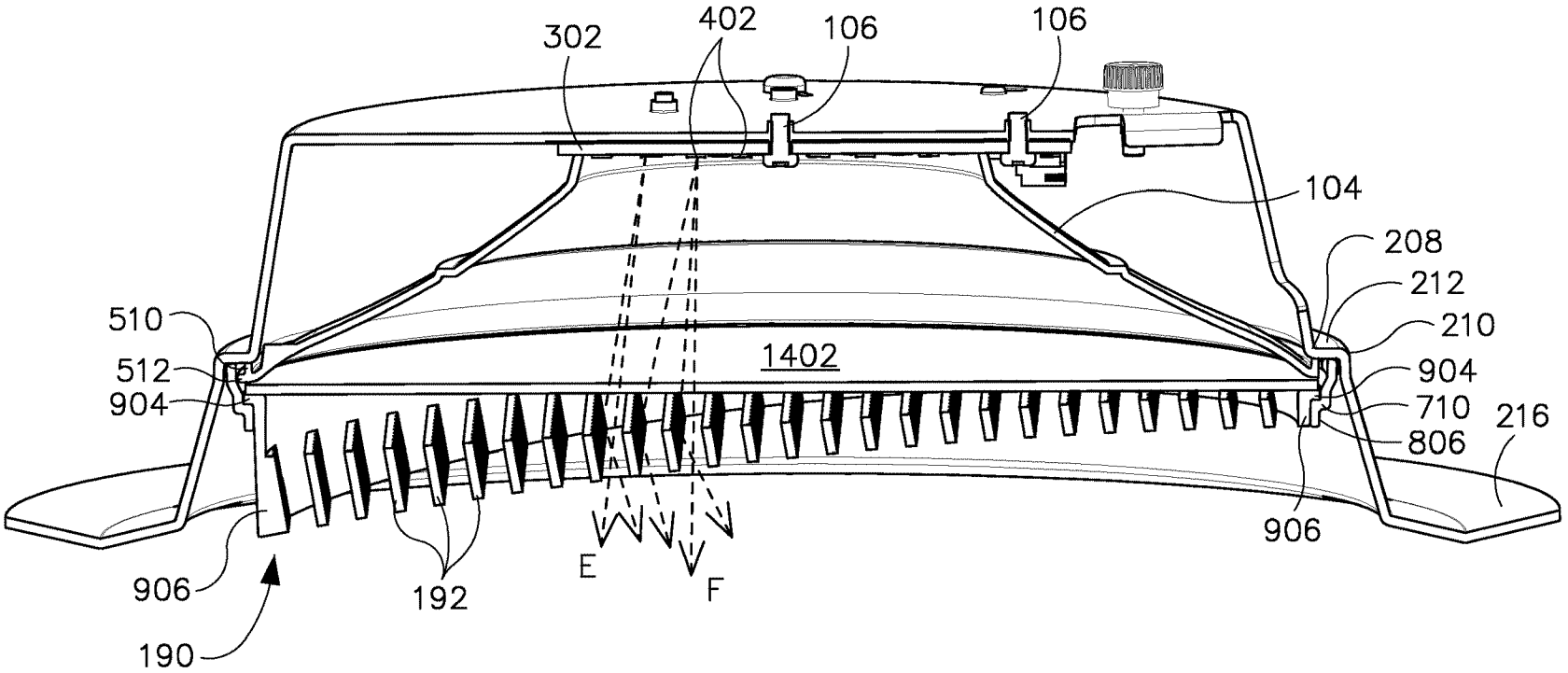
FIG. 14 illustrates a cross-sectional view of the low profile wall wash recessed downlight with the example light redistribution apparatus of FIG. 1, in accordance with example embodiments of the present disclosure.
Figure 15:
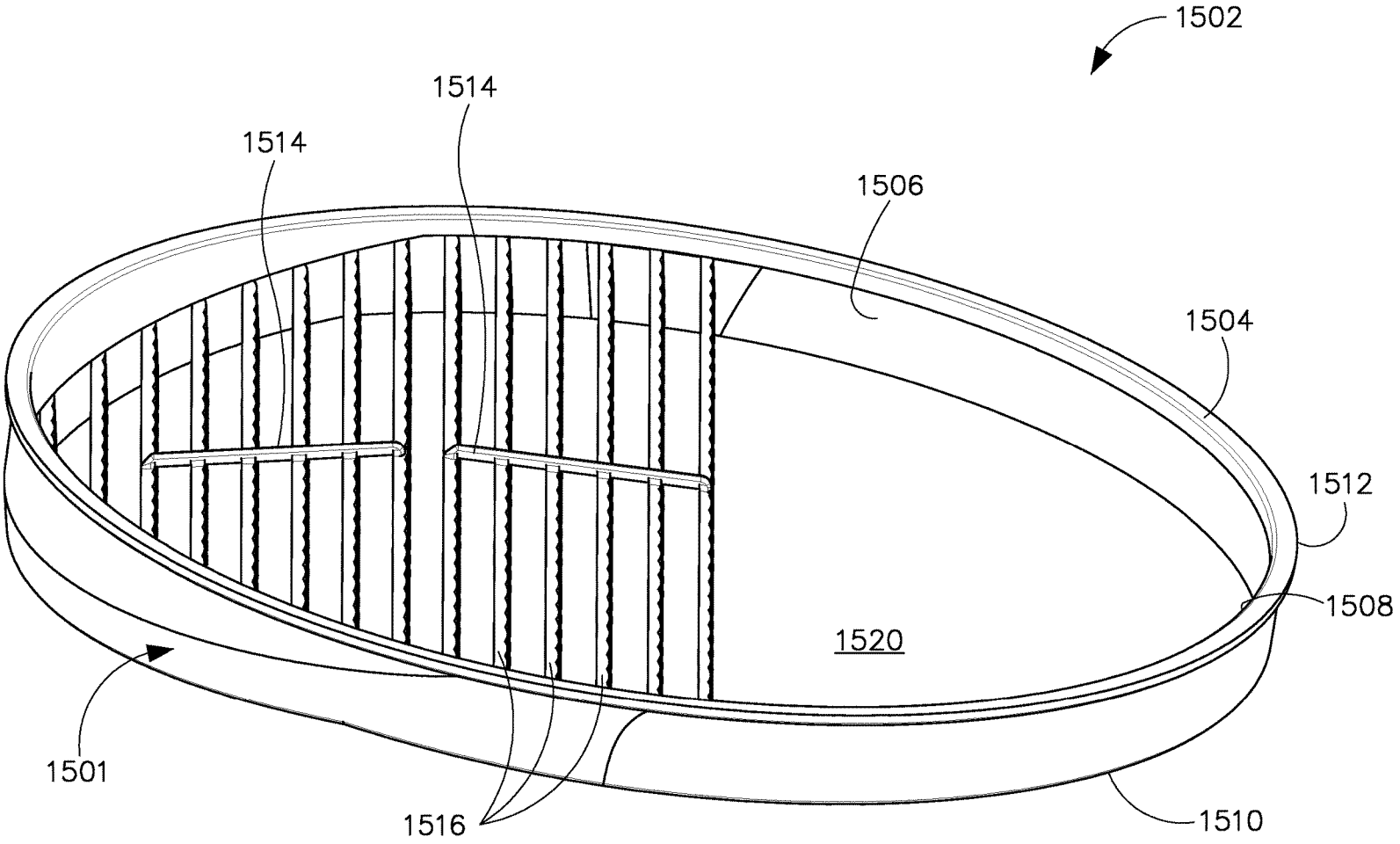
FIGS. 15 and 16 illustrate a top perspective view and a bottom perspective view of another example light redistribution apparatus, in accordance with example embodiments of the present disclosure.
Figure 16:
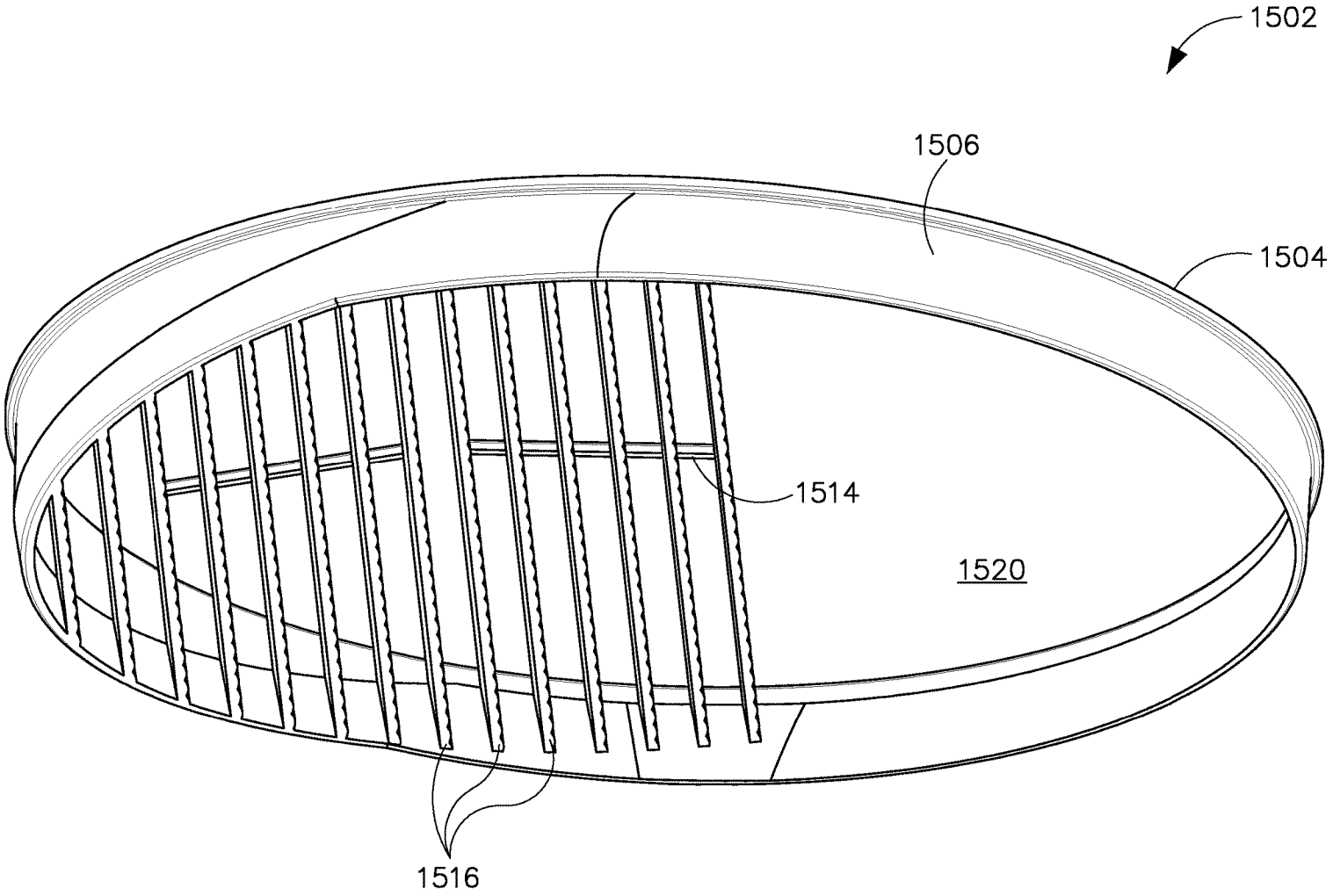
Figure 17:
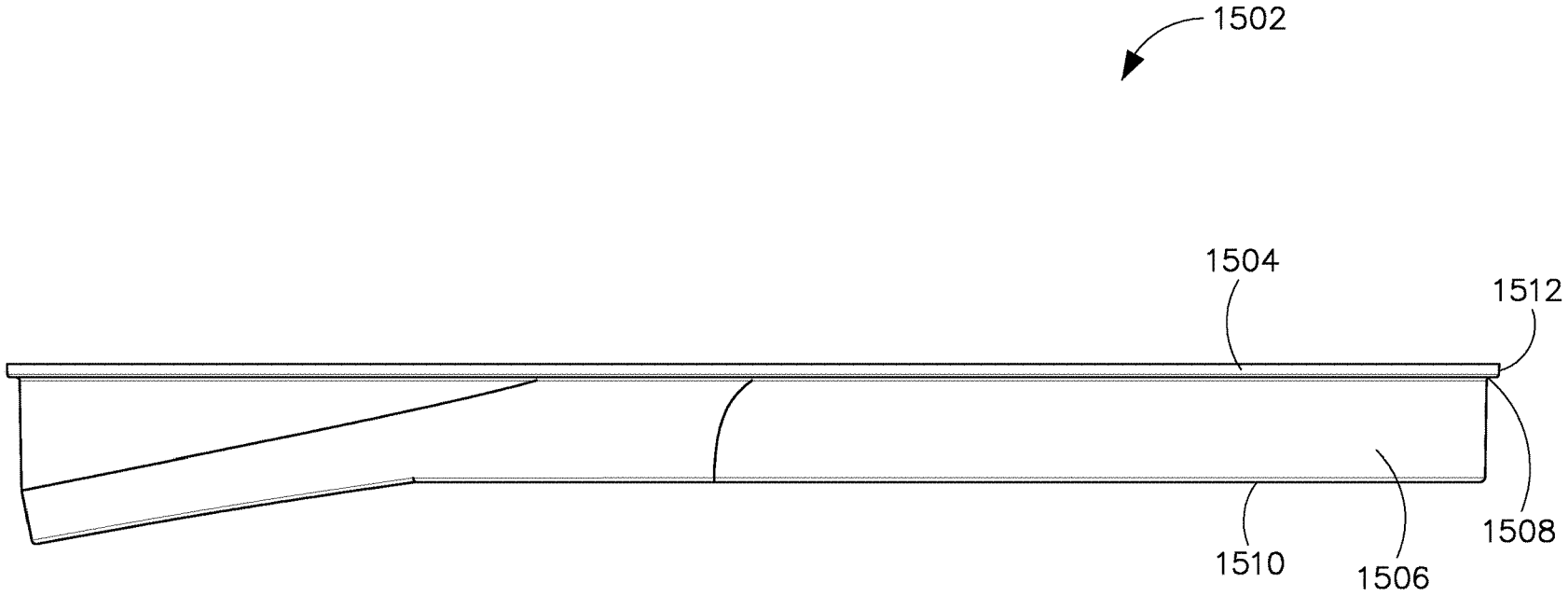
FIG. 17 illustrates a side view of the other example light redistribution apparatus of FIGS. 15 and 16, in accordance with example embodiments of the present disclosure.
Figure 18:
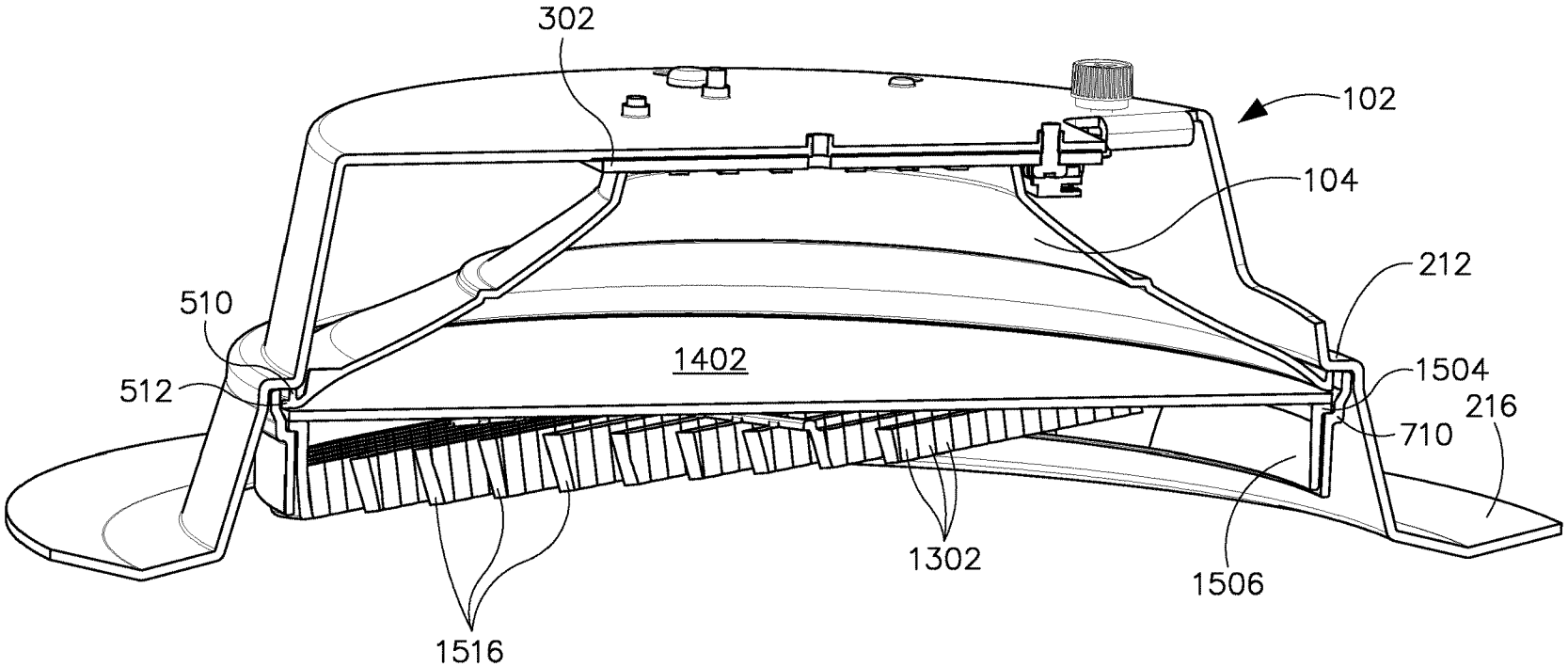
FIG. 18 illustrates a cross-sectional view of the low profile wall wash recessed downlight with the other example light redistribution apparatus of FIGS. 15 and 16, in accordance with example embodiments of the present disclosure.

Further, the light module 302 may include connector receptacles 110 that are configured to mate with connector pins to provide electrical power to the light module 302. The connector pins may be coupled to electrical wires (housed in a conduit) from an external power supply (not shown). As illustrated in FIGS. 1, 14, and 18, the light module 302 may be coupled to the housing 102 using fasteners 106 such that the connector receptacle 110 faces the opening 112 of the housing 102. In other words, the light module 302 may be coupled to the housing 102 such that the opening 112 of the housing 102 exposes the connector receptacle 110 of the light module 302 for easy mating with the connector pins that supply power to the light module 302.

In certain example embodiments, the light source 402 of the light module 302 may be a point source, such as a light emitting diode (LED). However, in other example embodiments, the light source 402 may include any other appropriate point or non-point light source without departing from a broader scope of the present disclosure.

Figure 5:
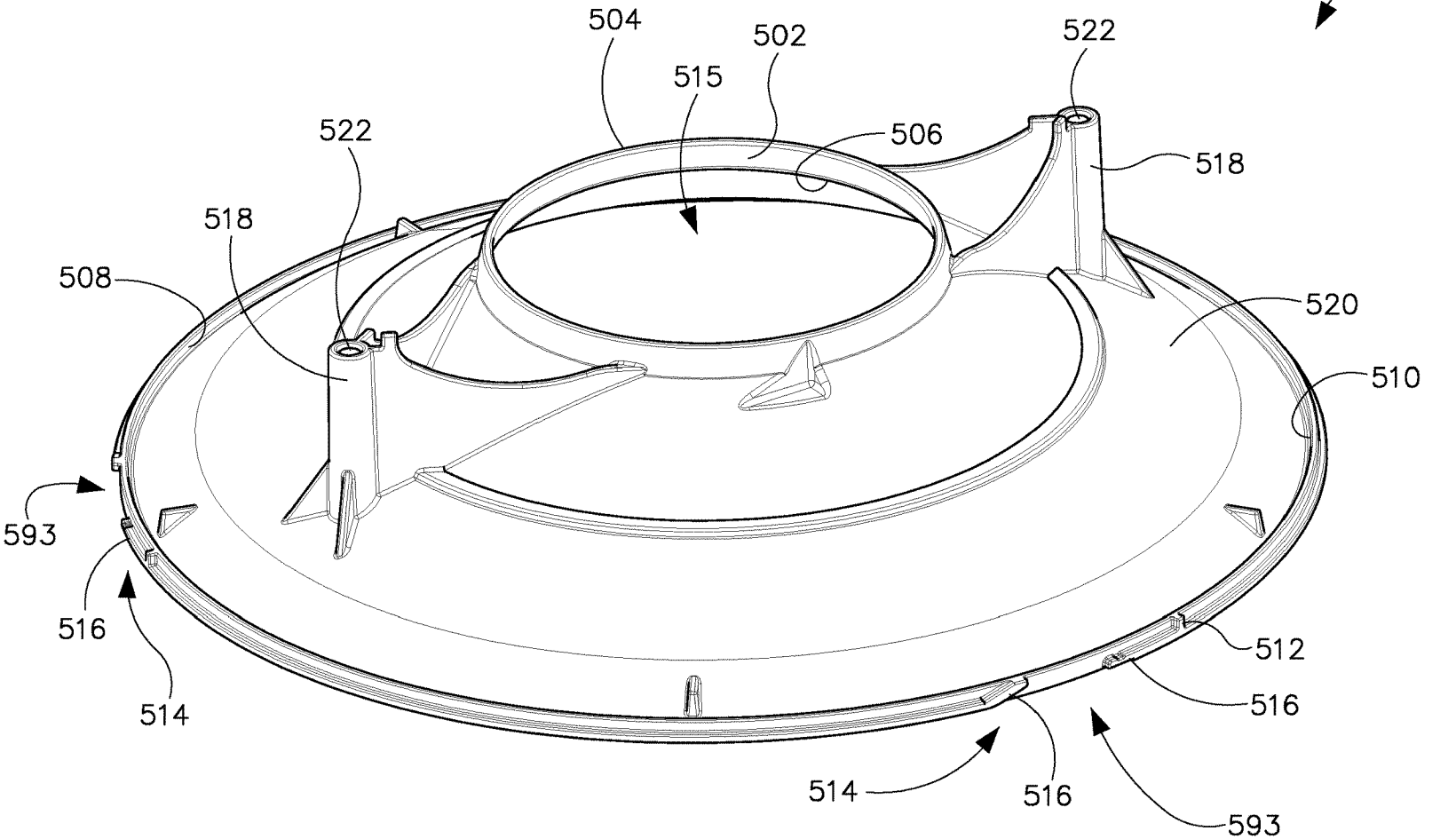
FIG. 5 illustrates a top perspective view of a reflector of the low profile wall wash recessed downlight of FIG. 1, in accordance with example embodiments of the present disclosure.
Figure 6:
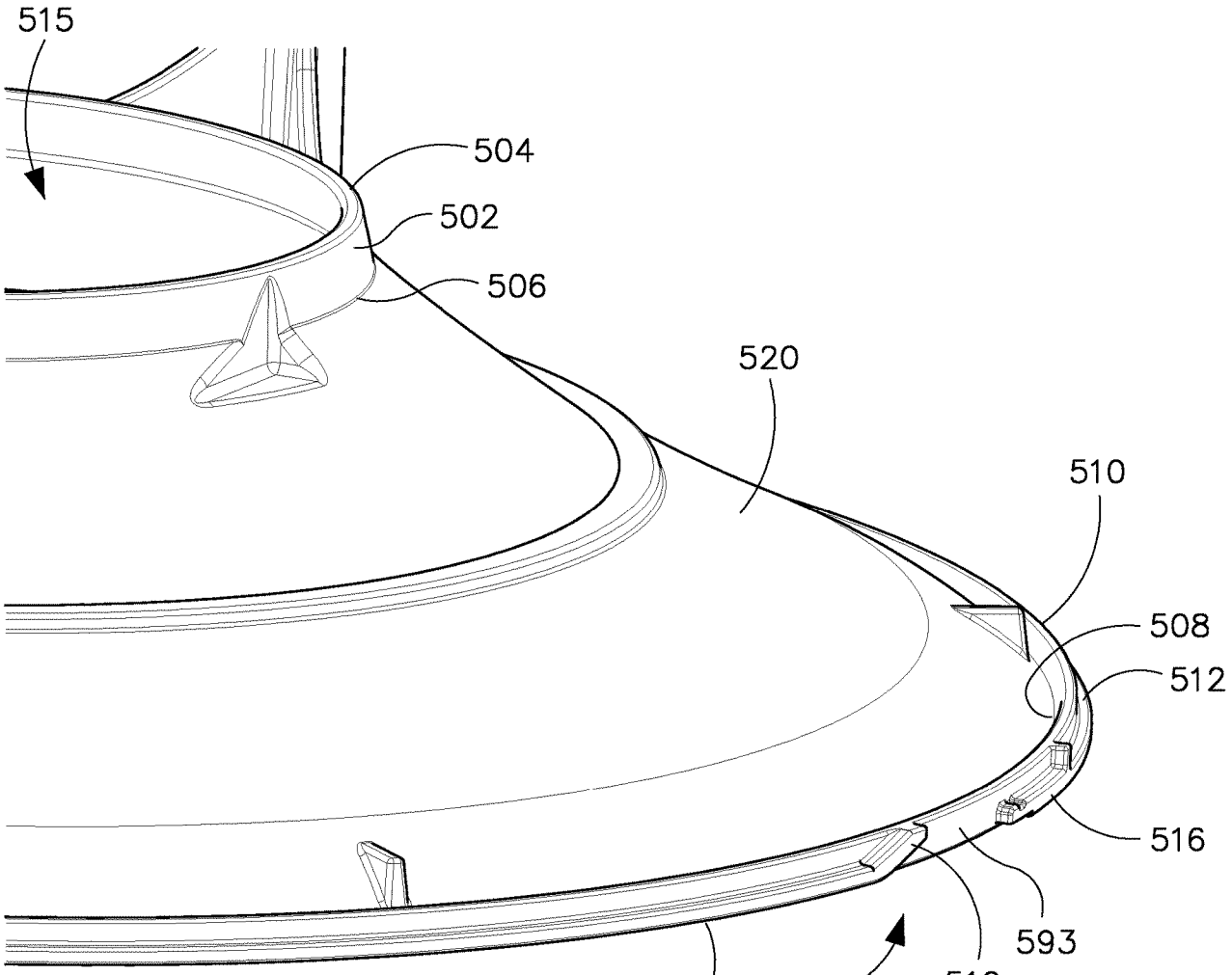
FIG. 6 illustrates an enlarged view of a portion of the reflector of FIG. 5, in accordance with example embodiments of the present disclosure.

Turning to FIGS. 5 and 6, a reflector 104 of the downlight 100 may include an annular top edge 506 that defines a light module receiving opening 515, an annular bottom edge 508 that defines a light exit opening 514, and a body 520 that extends between the annular top edge 506 and the annular bottom edge 508. Further, the reflector 104 may include a top collar 502 that extends substantially vertically upwards from the annular top edge 506 towards an annular outer edge 504. Furthermore, the reflector 104 may include: (i) a first flange 512 that extends substantially horizontally and radially outward from the annular bottom edge 508 of the reflector 104, and (ii) a second flange 510 that extends upward and substantially perpendicular to the first flange 512 from the annular bottom edge 508 of the reflector 104. Additionally, the reflector 104 may include one or more twist-lock features 516 configured on the first flange 512 to couple an outer support ring 702 to the reflector 104. The outer support ring 702 will be described in greater detail below in association with FIGS. 7 and 8. The reflector 104 may also include two screw bosses 518 that have apertures 522 that are configured to receive fasteners 108 therethough to couple the reflector 104 to the housing 102.

In particular, as illustrated in FIGS. 14 and 18, to couple the reflector 104 to the housing 102, the reflector 104 may be positioned within the cavity 193 of the housing 102 such that: (a) the apertures 522 of the reflector screw bosses 518 align with the one or more second coupling apertures 218 of the housing 102, (b) the annular outer edge 504 of the reflector's top collar 502 engages the circuit board 306 that is coupled to the housing 102 such that the one or more light sources 402 are positioned within the light module receiving opening 515, and (c) a top edge of the second flange 510 engages the lip 212 (interior surface of lip facing cavity 193) of the housing 102. Further, fasteners 108 are passed through the aligned apertures (218 and 522) of the housing 102 and the reflector 104 to securely retain the reflector 104 within the housing 102.

Figure 7:
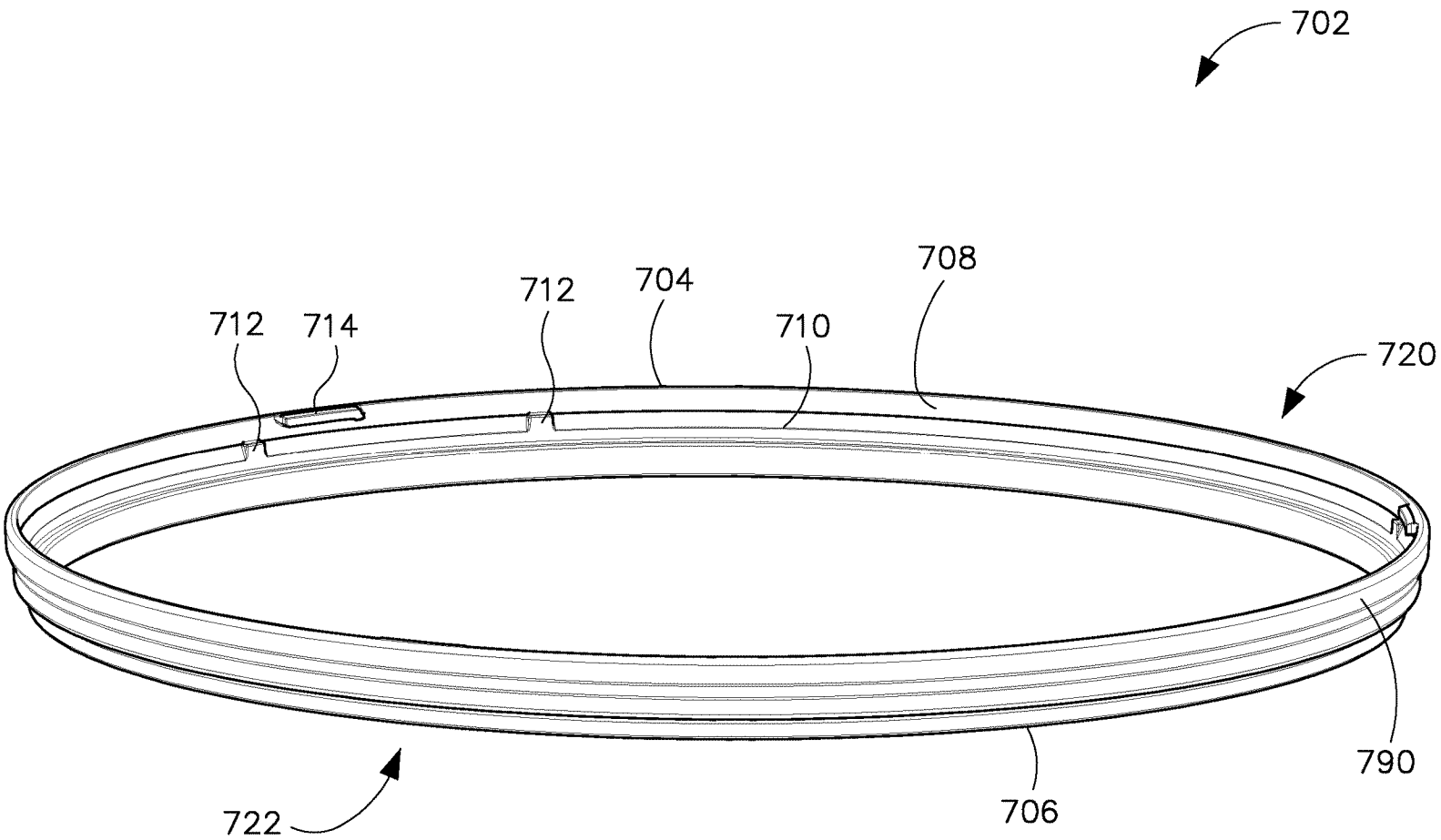
FIG. 7 illustrates a top perspective view of an outer support ring of the low profile wall wash recessed downlight of FIG. 1, in accordance with example embodiments of the present disclosure.
Figure 8:
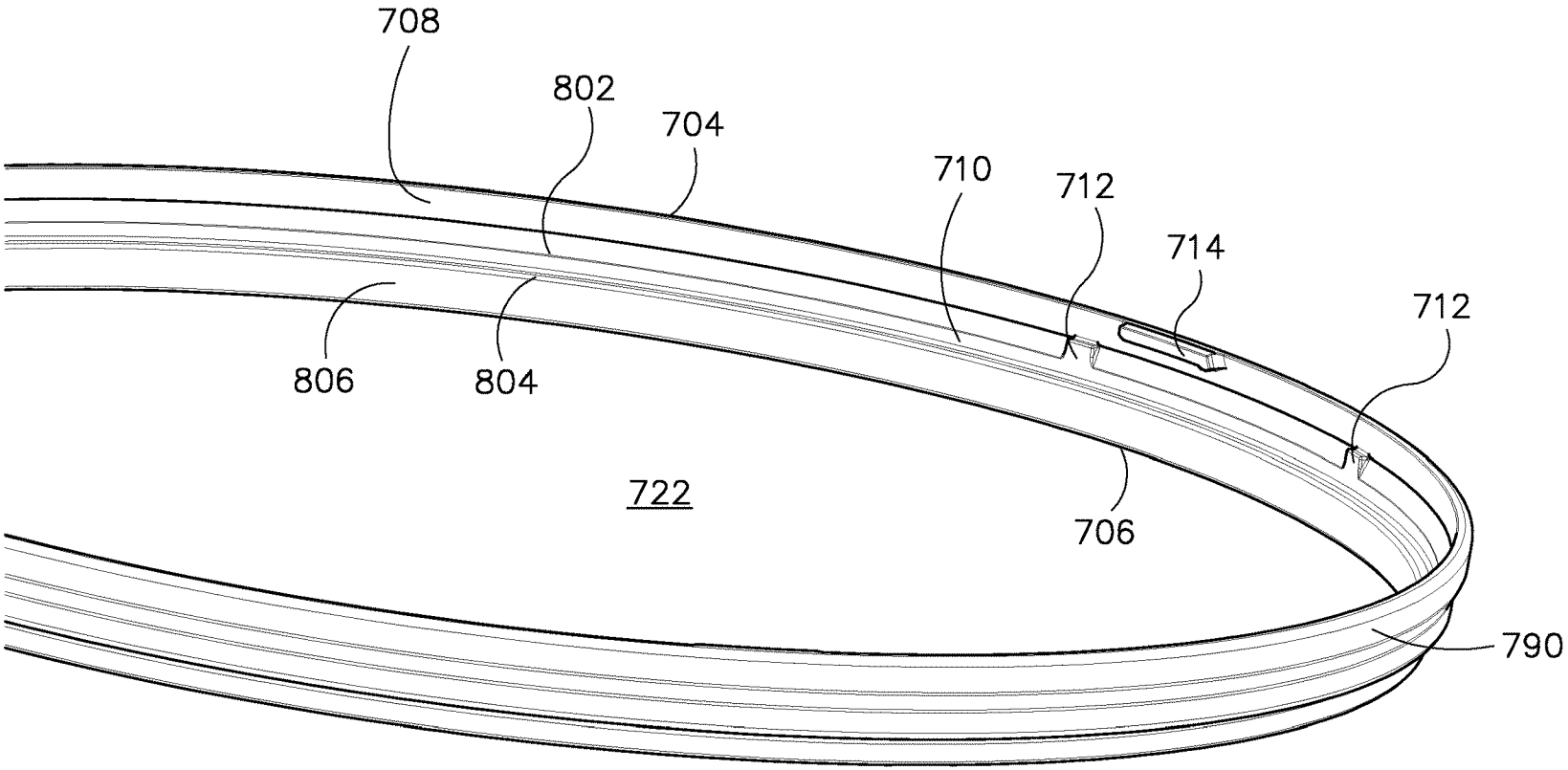
FIG. 8 illustrates an enlarged view of a portion of the outer support ring of FIG. 7, in accordance with example embodiments of the present disclosure.

Turning to FIGS. 7 and 8, the outer support ring 702 of the downlight 100 includes a top annular edge 704 that defines a top opening 720, a bottom annular edge 706 that defines a bottom opening 722, and a ring body 790 that extends between the top annular edge 704 and the bottom annular edge 706. In particular, the body 790 of the annular support ring 702 includes a top portion 708 that extends from the top annular edge 704 towards an intermediate annular edge 802 that is disposed in between the top annular edge 704 and the bottom annular edge 706. Further, the body 790 includes a lip 710 that extends radially inward from the intermediate annular edge 802 towards an inner edge 804 of the lip 710. Furthermore, the body 790 includes a bottom portion 806 that extends from an inner edge 804 of the lip 710 towards the bottom annular edge 706 of the outer support ring 702. The lip 710 may operate as a seat or support member for supporting and securely retaining a lens 1402 and/or the light redistribution apparatus 190 or 1502 within the downlight housing 102 as illustrated in FIGS. 14 and 18.

Additionally, as illustrated in FIGS. 7 and 8, the outer support ring 702 may include one or more indexed features 712 and 714 that are configured to twist and lock the outer support ring 702 to the reflector 104. In certain example embodiments, the outer support ring 702 may be coupled to the reflector 104 by: positioning the outer support ring 702 below the reflector 104 such that the indexed feature 714 (protrusion) of the outer support ring 702 is placed below the recess portion 593 of the reflector 104, and pushing the outer support ring 702 up towards the reflector 104 such that the indexed feature 714 of the outer support ring 702 is received by the recess portion 593 of the reflector 104. Further, the outer support ring 702 or the reflector 104 is twisted such that: (a) the indexed feature 714 (protrusion) of the outer support ring 702 engages the twist-lock feature 516 (top surface) of the reflector 104, and (b) the indexed features 712 (tabs) of the outer support ring 702 engage the first flange 512 (bottom surface of first flange) of the reflector 104. The indexed features 712 (tabs) of the outer support ring 702 act as a stop mechanism that prevents the outer support ring 702 from being pushed all the way into the reflector 104.

Figure 19:
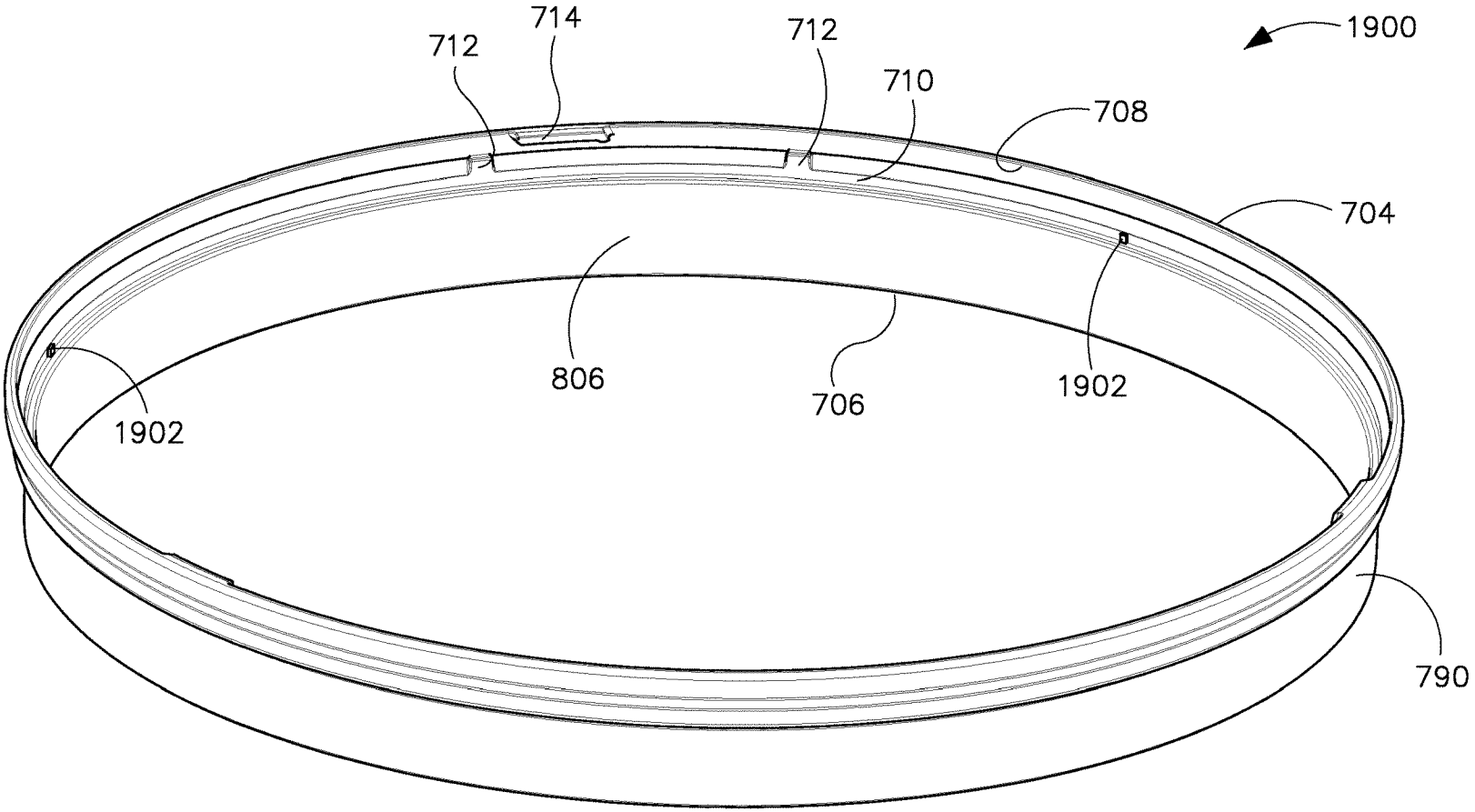
FIG. 19 illustrates a top perspective view of another example outer support ring of the low profile wall wash recessed downlight, in accordance with example embodiments of the present disclosure.

When the outer support ring 702 is coupled to the reflector 104, there may be a space between the lip 710 of the outer support ring 702 and the first flange 512 of the reflector 104. As illustrated in FIGS. 14 and 18, the space may be configured to securely retain and rotatably couple a lens 1402 and/or the light redistribution apparatus 190, 1502, or 2002 within the downlight housing 102. In some example embodiments, in addition to the one or more indexed features 712 and 714, the inner surface of the outer support ring 1900 may include a plurality of interference features or bump features 1902 as illustrated in FIG. 19. The interference features 1902 are configured to provide friction against an outer surface of the light redistribution apparatus 190, 1502, or 2002 to prevent a free rotation of the light redistribution apparatus 190, 1502, or 2002 in the recessed downlight 100 or a further rotation of the light redistribution apparatus 190, 1502, or 2002 once the light redistribution apparatus is disposed in the recessed downlight 100 and is rotated to a desired orientation.

Turning to FIGS. 9-21, the light redistribution apparatus 190, 1502, or 2002 of the recessed downlight 100 may be described in greater detail. In particular, the light redistribution apparatus may be configured to redistribute a portion of light emitted by the downlight 100 towards a vertical surface while a remainder portion of light is directed towards another area to be illuminated (e.g., floor area below the downlight). First, FIGS. 9-14 will be described with reference to a first example light redistribution apparatus 190; then, FIGS. 15-18 will be described with reference to a second example light redistribution apparatus 1502; followed by FIGS. 19-21 that will be described with reference to yet another example light redistribution apparatus.

Referring to FIGS. 9-21, the light redistribution apparatus 190 may include an outer collar 901 that is substantially ring shaped. However, in other example embodiments, the outer collar 901 may have any other appropriate geometric and non-geometric shape without departing from a broader scope of the present disclosure. In particular, the collar 901 may include a top annular edge 910 that defines a top opening, a bottom annular edge 908 that defines a bottom opening, and a body 906 that extends from the top annular edge 910 towards the bottom annular edge 908 and defines a cavity 903 that extends from the top opening to the bottom opening. In certain example embodiments where the outer collar 901 is non-circular, one of ordinary skill in the art can understand and appreciate that the top and bottom edges may not be annular.

The body 906 of the outer collar 901 may have an inner surface 905 and an outer surface 907. In some example embodiments, the inner surface 905 of the outer collar body 906 may be made reflective. For example, the inner surface 905 of the outer collar body 906 may be coated with a reflective paint or white paint. Alternatively, the outer collar 901 may be formed using reflective material. However, in other example embodiments, the inner surface 905 of the outer collar body 906 may not be made reflective.

Further, as illustrated in FIGS. 9-14, the body 906 of the outer collar 901 may taper in height from one side towards an opposite side. That is, the distance between the top edge 910 and the bottom edge 908 of the outer collar 901 may reduce from one side towards an opposite side in the direction of the X-X' axis along the diameter of the top and bottom annular edges (910, 908). Furthermore, the outer collar 901 may include a coupling flange 904 that extends radially outward and substantially horizontally from the top annular edge 910.

Figure 20:
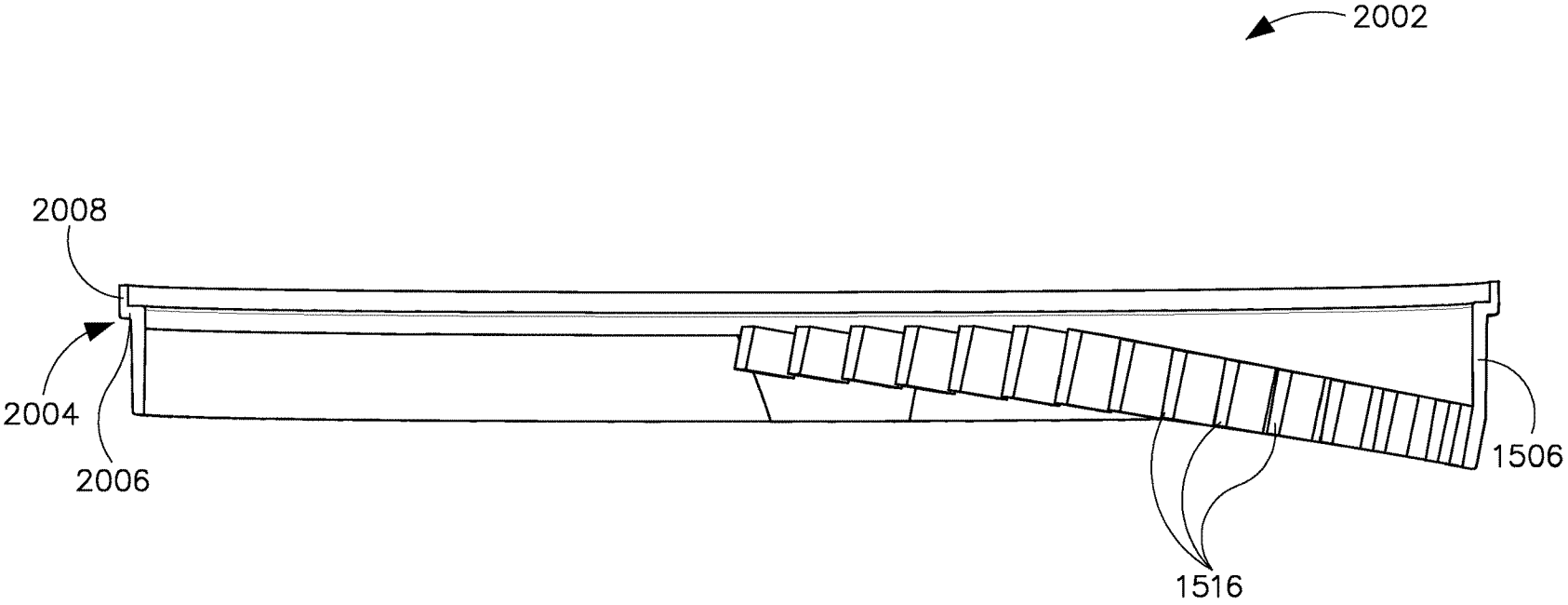
FIG. 20 illustrates a cross-sectional view of yet another example light redistribution apparatus, in accordance with example embodiments of the present disclosure.

In some example embodiments, an example light redistribution apparatus 2002 may include a coupling flange 2004 that is substantially L-shaped as illustrated in FIG. 20. The coupling flange 2004 may include a first flange portion 2006 that extends radially outward and substantially horizontally from the top annular edge 910 and a second flange portion 2008 that extends vertically and substantially perpendicular to the first flange portion 2006 from an outer edge of the first flange portion 2006.

Turning back to FIGS. 9-14, in addition to the outer collar 901, the light redistribution apparatus 190 may include a plurality of redirection segments 192 that are disposed across the cavity 903 of the outer collar 901 and integral with the outer collar 901, as illustrated in FIGS. 9-12. In particular, the redirection segments 192 are arranged substantially perpendicular to the X-X' axis along which the height of the outer collar body 906 tapers. In other words, the redirection segments 192 are disposed within the cavity 903 of the outer collar 901 such that they are parallel to the Y-Y' diameter that is substantially perpendicular to the direction in which the height of the outer collar body 906 tapers. Furthermore, in certain example embodiments, adjacent redirection segment pairs 192 may be separated by an equal distance, however, in other example embodiments, adjacent redirection segment pairs 192 may be separated by varying distances without departing from a broader scope of the present disclosure.

Figure 9:
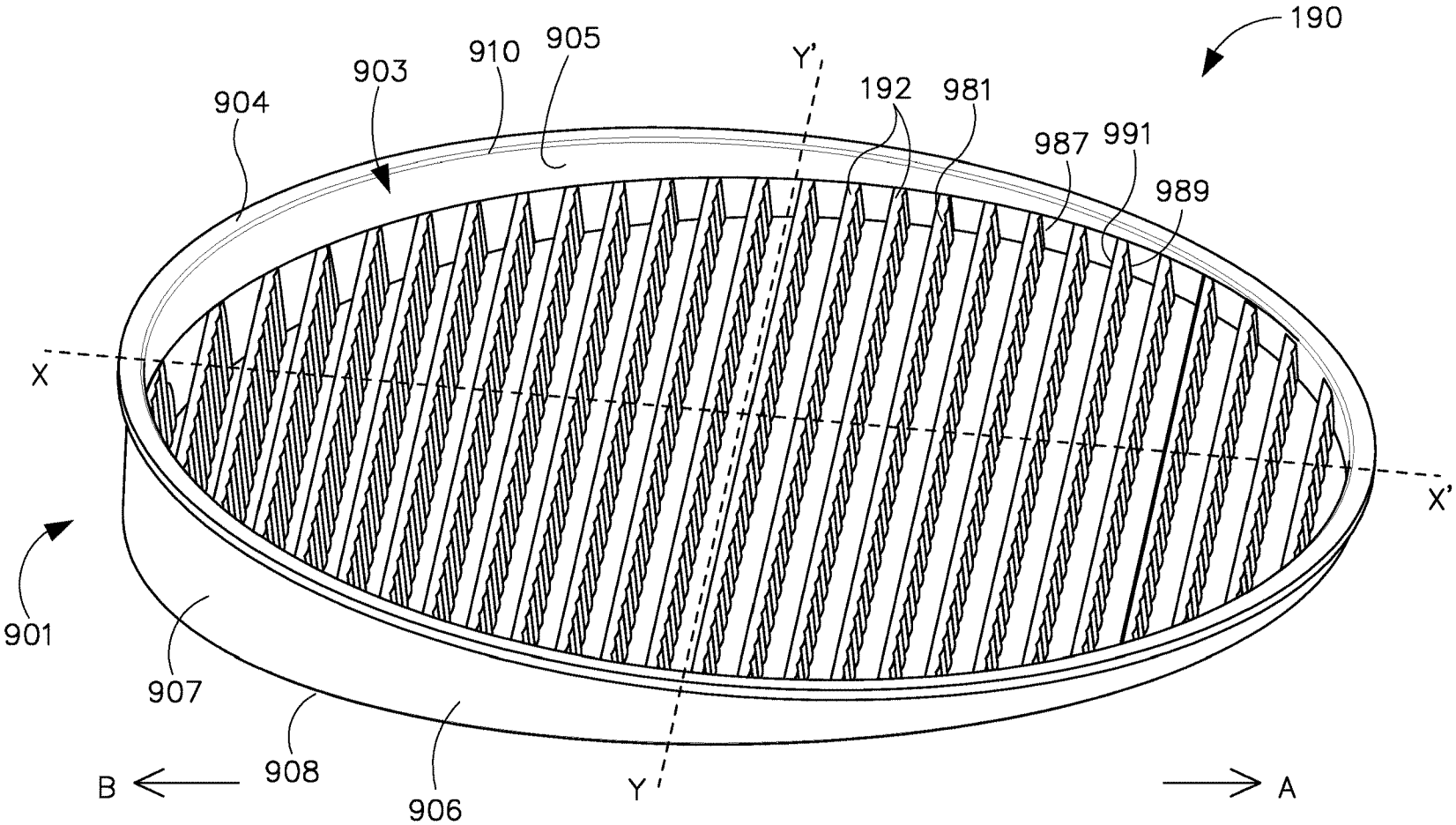
FIGS. 9 and 10 illustrate a top perspective view and a bottom perspective view of the example light redistribution apparatus of the low profile wall wash recessed downlight of FIG. 1, in accordance with example embodiments of the present disclosure.
Figure 10:
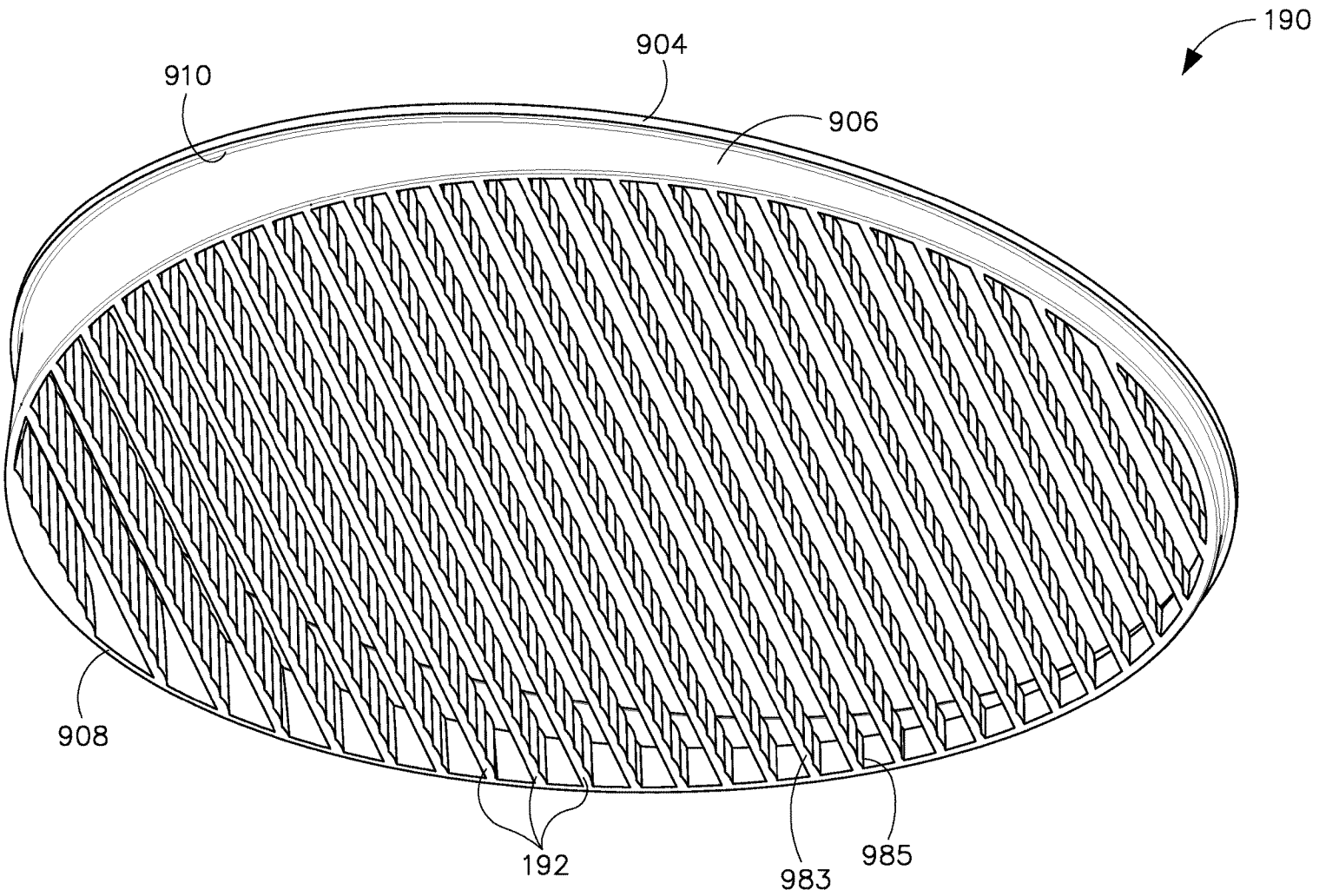
Figure 11:
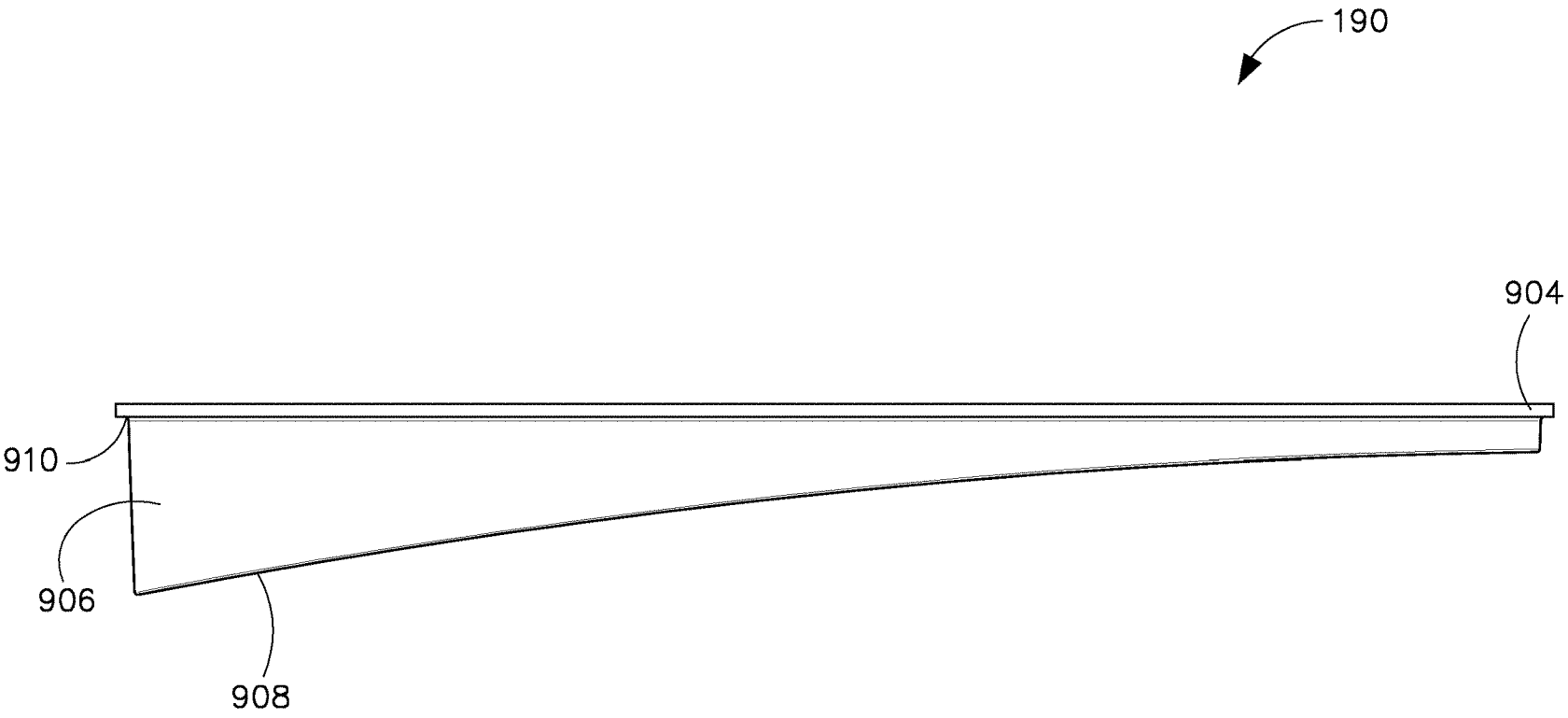
FIG. 11 illustrates a side view of the example light redistribution apparatus of FIGS. 9 and 10, in accordance with example embodiments of the present disclosure.

Each redirection segment 192 may be substantially rectangular shaped. That is, each redirection segment 192 may have two longitudinal edges 981 and 983 that are opposite to each other, two lateral edges 985 and 987 that are disposed opposite to each other and between the two longitudinal edges 981 and 983, a first major surface 989, and a second major surface 991 disposed opposite to the first major surface 989. The first major surface 989 and the second major surface 991 may be disposed between the two longitudinal edges (981, 983) and the two lateral edges (985, 987). In particular, as illustrated in FIGS. 9, 10, and 12-14, the second major surface 991 of each redirection segment 192 may be smooth while the first major surface 989 of each redirection segment 192 may have rippled surface, i.e., a plurality of curved features 1302 across the length of the respective redirection segment 192, i.e., from the one lateral end 985 to the opposite lateral end 987 of the respective redirection segment 192. The curved features 1302 on the first major surface 989 of each redirection segment 192 may appear like ripples on the surface, and each curved feature 1302 extends from one longitudinal edge 981 to the opposite longitudinal edge 983. In other example embodiments, the second major surface 991 may have the curved features 1302 instead of the first major surface 989, or alternatively, both the major surfaces 989 and 991 may have the curved features 1302. Further, as illustrated in FIGS. 9 and 10, each redirection segment 192 may be coupled to the inner surface 905 of the outer collar 901 via the lateral edges 985 and 987 of respective redirection segment 192.

Figure 12:
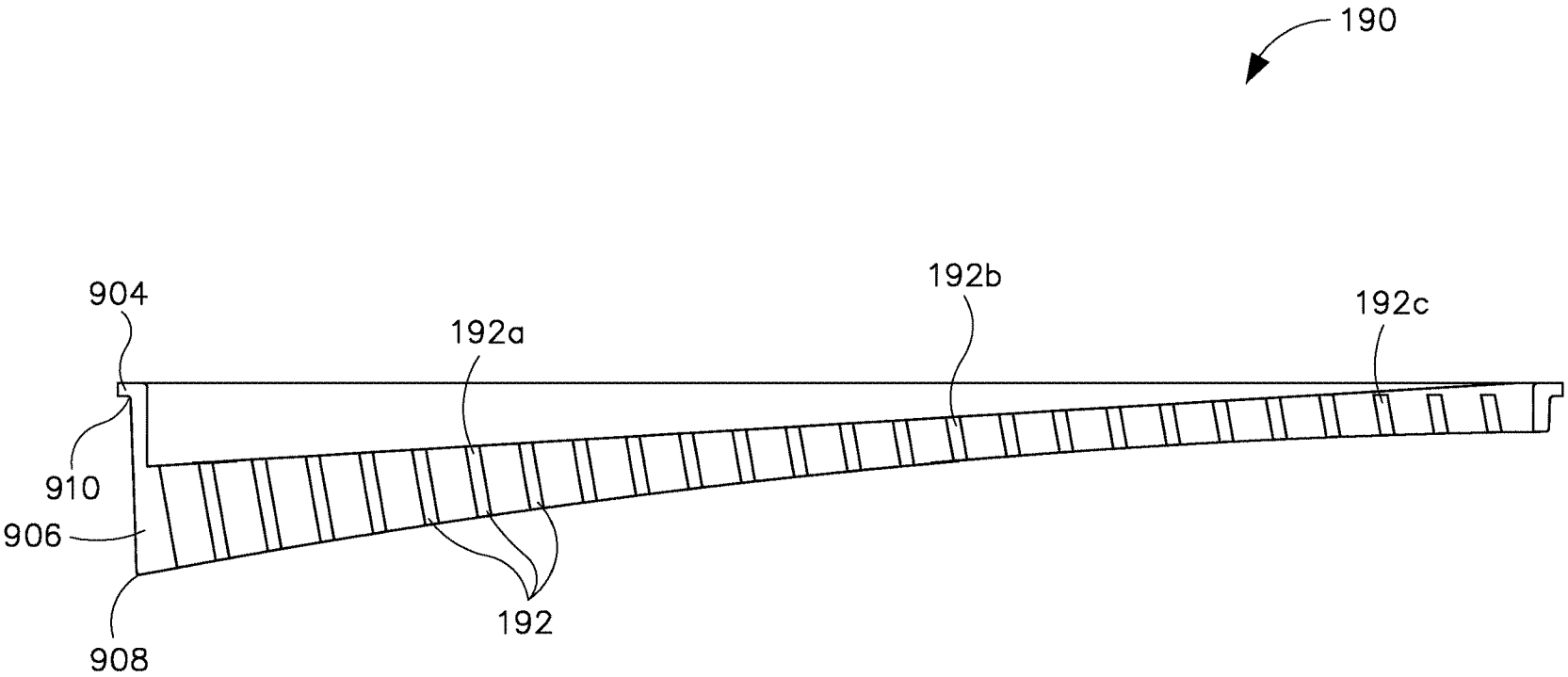
FIG. 12 illustrates a cross-sectional view of the example light redistribution apparatus of FIGS. 9 and 10, in accordance with example embodiments of the present disclosure.
Figure 13:
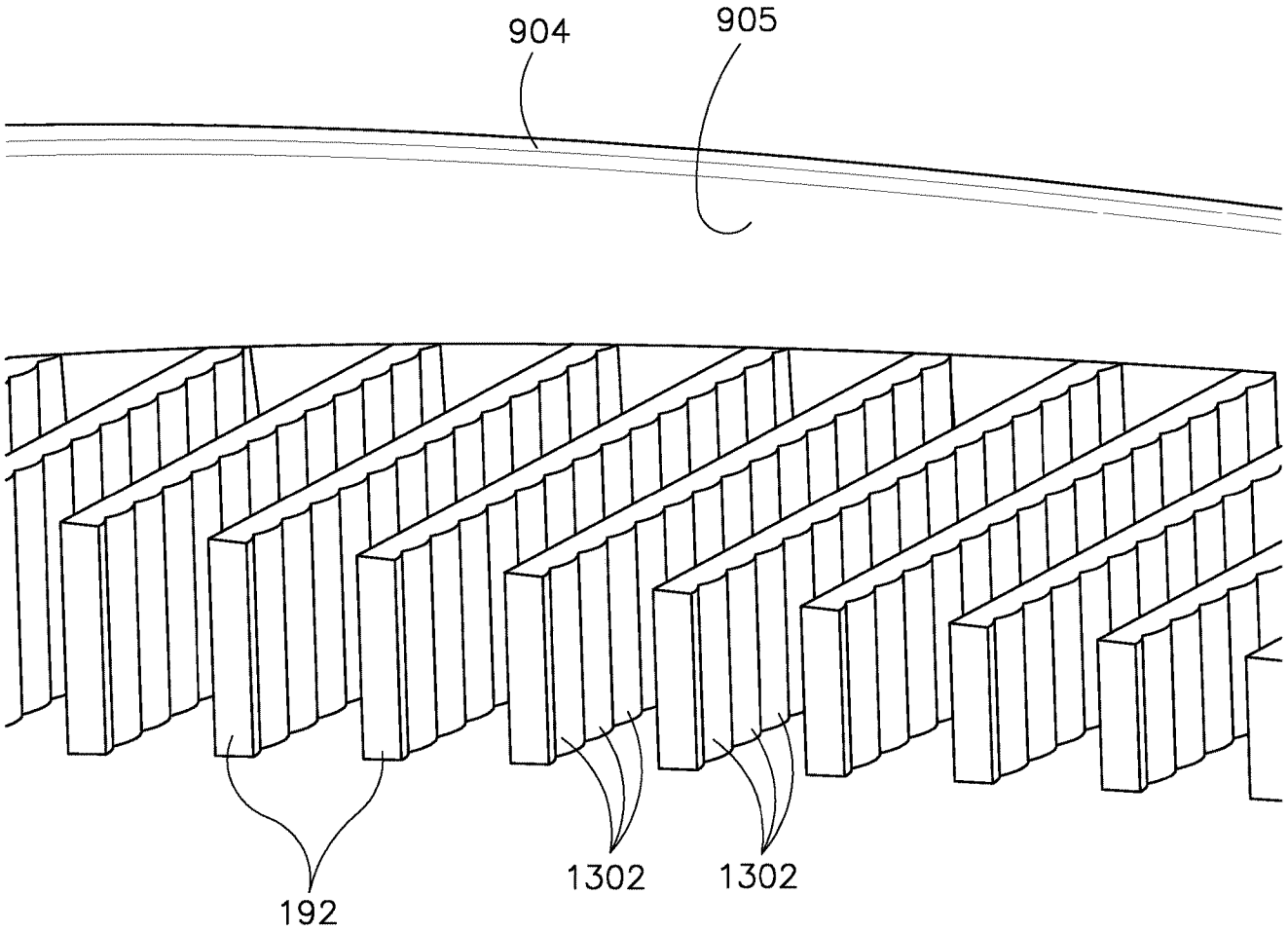
FIG. 13 illustrates an enlarged view of a portion of the example light redistribution apparatus of FIGS. 9 and 10, in accordance with example embodiments of the present disclosure.

Additionally, as illustrated in FIGS. 9, 10, 12, 13, 14, and 20-21, the height or the distance between the two longitudinal edges 981 and 983 of the redirection segments 192 may vary in the direction of the X-X' diameter. That is, the height of adjacent pairs of redistribution segments may differ from each other. In certain example embodiments, the height of the redirection segments 192 progressively reduces or increases from one end to the opposite end of the outer collar body 906 in the direction of the X-X' diameter (direction A or direction B). For example, as illustrated in FIG. 12, the height of the redirection segments decrease from redirection segment 192*a* towards redirection segment 192*c*. However, in other example embodiments, the height of the redirection segments 192 may vary differently from one end to the opposite end of the outer collar body 906 along the X-X' diameter (direction A or direction B). For example, the height of redirection segment 192*b* may be greater than the height of the redirection segments 192*a* and 192*c*.

In certain example embodiments, the redirection segments 192 may extend from the bottom annular edge 908 of the outer collar 901 towards, but not all the way to the top annular edge 910 of the outer collar 901. However, in other example embodiments, the redirection segments 192 may extend from the top annular edge 910 towards, but not all the way to the bottom annular edge 908, or from the top annular edge 910 all the way to the bottom annular edge 908 without departing from a broader scope of the present disclosure. In yet another example embodiment, the redirection segments 192 may extend beyond or outside the top annular edge 910 and/or bottom annular edge 908 of the outer collar 901. That is, the redirection segments 192 may extend past and project out from the top annular edge 910 and/or bottom annular edge 908 of the outer collar 901, in some embodiments.

Further, each redirection segment 192 may be configured at an angle (not perpendicular) to the top annular edge 910 and the bottom annular edge 908 of the outer collar 901. For example, as illustrated in FIGS. 12 and 14, each redirection segment 192 may be disposed within the cavity 903 of the outer collar 901 such that they form an obtuse or acute angle with the top annular edge 910 and the bottom annular edge 908 of the outer collar 901. The angle at which the redirection segments 192 are configured may vary based on the vertical surface that needs to be illuminated.

Even though the present disclosure describes the light redistribution apparatus 190 as having redirection segments 192 disposed within the cavity 903 of the outer collar 901 from one end to the opposite end along the X-X' diameter, one of ordinary skill in the art can understand and appreciate that in some example embodiments, the redirection segments 192 may not be disposed across the entire cavity 903, i.e., all the way from one end to the opposite end along the X-X' diameter. Instead, in said example embodiments, the redirection segments 192 may be disposed only across a portion of the cavity 903 without departing from a broader scope of the present disclosure. For example, as illustrated in FIGS. 15-18 and 20-21, the redirection segments 192 may be disposed only over half of the cavity 903. The light redistribution apparatus 1502 of FIGS. 15-18 and 20-21 may be substantially similar to the light redistribution apparatus 190 of FIGS. 1-14, except for a few additional features. Accordingly, only the few additional features will be described herein for sake of brevity.

Turning to FIGS. 15-18, unlike the outer collar 901 of the light redistribution apparatus 190 that reduces in height from one end to another, the outer collar 1501 of the light redistribution apparatus 1502 may reduce in height to a certain extent and then remain constant in a remaining portion. The outer collar 1501 has a body 1506 that extends from a top edge 1508 to a bottom edge 1510. Further, the light redistribution apparatus 1502 includes a coupling flange 1504 that extends from the top edge 1508 to an outermost edge 1512. The body 1506 defines a cavity 1520. Further, the light redistribution apparatus 1502 may include one or more support ribs 1514 that may be disposed on the top edge (first longitudinal edge) of the redirection segments 1516 to provide additional support and stability to the redirection segments 1516. Further, as described above, the redirection segments 1516 may cover or may be disposed only across half of the cavity 1520 unlike the light redistribution apparatus 190 of FIGS. 1-14.

As illustrated in FIGS. 14 and 18, the light redistribution apparatus 190 or 1502 may be coupled to the downlight 100 by: (a) disposing the coupling flange 904 or 1504 of the light redistribution apparatus 190 or 1502 on the lip 710 of the outer support ring 702, (b) positioning the lens 1402 on top of the light redistribution apparatus 190 or 1502 such that a perimeter of the lens 1402 is disposed on top of the coupling flange 904 or 1504 of the light redistribution apparatus 190 or 1502, and (c) twisting and locking the outer support ring 702 to the reflector 104. That is, as illustrated in FIGS. 14 and 18, the lens 1402 and the coupling flange 904 or 1504 (coupling collar) of the light redistribution apparatus 190 or 1502 may be sandwiched between the first flange 512 of the reflector 104 and the lip 710 of the outer support ring 702 such that the lens 1402 and the light redistribution apparatus 190 or 1502 can rotate once installed. In other words, the lens 1402 and the light redistribution apparatus 190 or 1502 may be rotatably coupled to the downlight 100 via the outer support ring 702. After installation, a user may rotate the light redistribution apparatus 190 or 1502 to direct the redistributed light to any appropriate vertical surface that the user desires to illuminate.

During operation, as illustrated in FIG. 14, light from the light module 302 may pass through the lens 1402 and engage the light redistribution apparatus 190 or 1502 such that: (i) a portion of the light that engages the curved features 1302 on the redirection segments' first major surface 989 may be reflected and redistributed towards direction F, while (ii) a remainder portion of the light may pass through the space in between the redirection segments 192 heading unobstructed towards direction E. The portion of the light that is redirected towards direction F may be used to illuminate a vertical surface, such as a vertical wall, while the remainder portion of the light that heads towards direction E may be used to illuminate any other appropriate portion, e.g., horizontal surface such as floor or a corridor. In particular, the first major surface 989 and the curved features 1302 may be made reflective to reflect and redirect the light towards direction F to illuminate a vertical wall. Further, the curved features 1302 may be configured to diffuse the reflected portion of the light and produce an asymmetric distribution of light that uniformly illuminates the vertical surface. Further, in some embodiments, the lens 1402 may also have reflective and/or diffusive properties.

Figure 21:
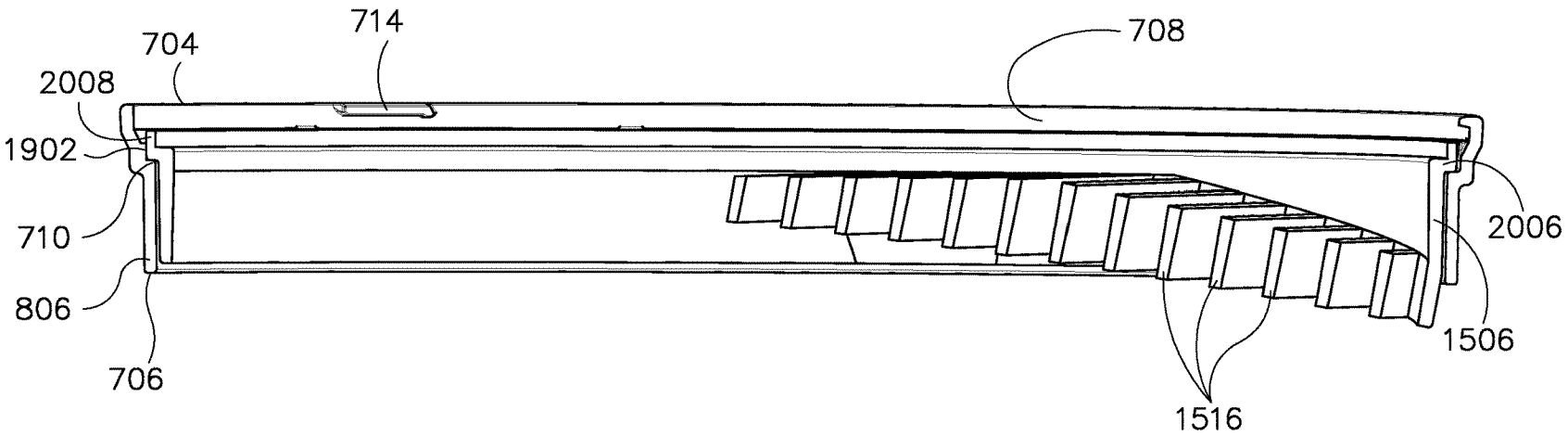
FIG. 21 illustrates a cross-sectional view of the yet another example light redistribution apparatus of FIG. 20 disposed in the other example outer support ring of FIG. 19, in accordance with example embodiments of the present disclosure.

Turning to FIGS. 19-21, as described above, in some example embodiments, the outer support ring 1900 may additionally include a plurality of interference features (tabs) 1902 formed in the inner surface of the outer support ring to prevent an undesirable rotation of the light redistribution apparatus 2002 (shown in FIG. 20) after the light redistribution apparatus 2002 is installed in the recessed downlight 100 and is rotated to a desired orientation. In particular, the light redistribution apparatus 2002 illustrated in FIG. 20 may be substantially similar to the light redistribution apparatus 1502 except for the coupling flange 2004. In the example light redistribution apparatus 2002 illustrated in FIG. 20, the coupling flange 2004 is substantially L-shaped with a first flange portion 2006 that extends radially outward and substantially horizontally from the top annular edge 910 and a second flange portion 2008 that extends vertically and substantially perpendicular to the first flange portion 2006 from an outer edge of the first flange portion 2006. As illustrated in FIG. 21, when the example light redistribution apparatus 2002 is coupled to the outer support ring 1900, the outer surface of the vertically oriented second flange portion 2008 engages the interference features 1902 of the outer support ring 1900 which in turn provides friction to keep the light redistribution apparatus 2002 in the desired orientation.

Even though the present disclosure describes that the redirection segments are integral with the outer collar, one of ordinary skill in the art can understand and appreciate that in some embodiments, the redirection segments may be removably coupled to the outer collar without departing from a broader scope of the present disclosure. Further, the redirection segments 192 may be rotatable/pivotable about the lateral edges of the redirection segments that couple the redirection segments to the outer collar to control the spread of redirected light on the vertical surface.

Further, even though the present disclosure describes the light redistribution apparatus as being used with a recessed wall wash downlight, one of ordinary skill in the art can understand and appreciate that in other example embodiments, the light redistribution apparatus may be used with any other appropriate type of light fixture without departing from a broader scope of the present disclosure. Furthermore, even though the present disclosure describes a specific structure of the downlight as having specific components, such as the housing, the reflector, the outer support ring, the lens, etc., one of ordinary skill in the art can understand and appreciate that in other example embodiments, the downlight can have fewer or more components without departing from a broader scope of the present disclosure. For example, in some embodiments, the downlight may not include the outer support ring. Instead, in said example, the lens and the light redistribution apparatus may be rotatably or fixedly coupled to the downlight using any other appropriate coupling mechanism without departing from a broader scope of the present disclosure. Further, in some example, the housing may not be a single continuous component, rather, the housing may be a multi-part component.

Furthermore, even though the present disclosure describes the outer support ring 702 or 1900 and the light redistribution apparatus 190, 1502, or 2002 as being two separate components that are coupled to each other and to an inner surface of the light fixture such that the light redistribution apparatus 190, 1502, or 2002 is rotatable within the light fixture, one of ordinary skill in the art can understand and appreciate that in other example embodiments, the outer support ring 702 or 1900 and the light redistribution apparatus 190, 1502, or 2002 may be integral to each other, i.e., they may be designed as one piece without departing from a broader scope of the present disclosure. In said embodiment where the outer support ring 702 or 1900 and the light redistribution apparatus 190, 1502, or 2002 may be integral to each other, the integral outer support ring 702 or 1900 and the light redistribution apparatus 190, 1502, or 2002 piece may be fixedly coupled to the light fixture, i.e., they may not be rotatable.

One of ordinary skill in the art can also understand and appreciate that the redirection segments vary in height from each other so that they can produce a wall wash illumination (wide and/or tall or spread out illumination) on the vertical surface. However, in other example embodiments, the height and size of the redirection segments 192 may be configured to produce any other type of illumination on the vertical surface without departing from a broader scope of the present disclosure. For example, the redirection segments 192 may be configured to produce a spotlight illumination on the vertical surface. Additionally, even though the present disclosure describes the body of the outer collar 901 as having varying height from one end to the other, one of ordinary skill in the art can understand that in some example embodiments, the body of the light redistribution apparatus's outer collar 901 may have a constant height throughout without departing from a broader scope of the present disclosure.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A light fixture comprising:

a housing that defines a first cavity;

a light module disposed in the first cavity and coupled to an inner surface of the housing, wherein the light module is configured to emit light in a first direction;

a light redistribution apparatus coupled to the housing and disposed in the first cavity such that it receives the light from the light module, wherein the light redistribution apparatus comprises:

an outer collar comprising a body that extends from a top edge toward a bottom edge and defines a second cavity; and a plurality of redirection segments that are disposed within the outer collar and across at least a portion of the second cavity such that they redirect a portion of the light from the first direction toward a second direction;

an outer support ring that is configured to couple the light redistribution apparatus to the housing; and a lens that is disposed in the first cavity and above the light redistribution apparatus.

2. The light fixture of claim 1, wherein the portion of the light that is redirected uniformly illuminates an area in the second direction, and wherein the area is a vertical wall surface.

3. The light fixture of claim 1, wherein the light redistribution apparatus further comprises a coupling flange that extends radially outwards and substantially horizontally from the top edge of the outer collar, and wherein the coupling flange is configured to rotatably couple the light redistribution apparatus to the housing.

4. The light fixture of claim 1:

wherein the light redistribution apparatus further comprises a coupling flange that is substantially L-shaped, wherein the coupling flange comprises:

a first flange portion that extends radially outward and substantially horizontally from the top edge of the outer collar, and a second flange portion that extends substantially perpendicular to the first flange portion from an end of the first flange portion, and wherein the coupling flange is configured to rotatably couple the light redistribution apparatus to the housing.

5. The light fixture of claim 1, wherein adjacent pairs of the plurality of redirection segments are separated by a space through which a remainder portion of the light directed in the first direction passes unobstructed to illuminate an area in the first direction.

6. The light fixture of claim 1:

wherein each redirection segment is substantially rectangular shaped and comprises: two longitudinal edges disposed opposite to each other, two lateral edges that are disposed opposite to each other and between the two longitudinal edges, a first major surface, and a second major surface disposed opposite to the first major surface, and wherein each redirection segment is coupled to an inner surface of the outer collar via their respective two lateral edges.

7. The light fixture of claim 1, wherein a height of each redirection segment of the plurality of redirection segments may vary from a height of other redirection segments of the plurality of redirection segments.

8. The light fixture of claim 1, wherein each redirection segment may be disposed within the outer collar such that it forms an obtuse angle or an acute angle with the top edge and bottom edge of the outer collar.

9. The light fixture of claim 6, wherein at least one of the first major surface and the second major surface of each redirection segment may comprise a plurality of curved features to diffuse the light.

10. A light redistribution apparatus comprising:

an outer collar that extends from a top edge toward a bottom edge and defines a cavity, wherein the top edge defines a top opening, the bottom edge defines a bottom opening, and wherein an outer collar height measured from the top edge to the bottom edge reduces from one end of the light redistribution apparatus to an opposite end; and a plurality of redirection segments that are disposed within the outer collar and across at least a portion of the cavity such that a portion of light that is emitted by a light module in a first direction is redirected by the plurality of redirection segments toward a second direction while allowing a remainder portion of the light to pass unobstructed toward the first direction.

11. The light redistribution apparatus of claim 10, wherein the portion of the light that is redirected uniformly illuminates an area in the second direction, and wherein the area is a vertical wall surface.

12. The light redistribution apparatus of claim 10, wherein the light redistribution apparatus further comprises a coupling flange that extends radially outward and substantially horizontally from the top edge of the outer collar, and wherein the coupling flange is configured to rotatably couple the light redistribution apparatus to a housing of a light fixture that houses the light module.

13. The light redistribution apparatus of claim 10:

wherein the light redistribution apparatus further comprises a coupling flange that is substantially L-shaped, wherein the coupling flange comprises:

a first flange portion that extends radially outward and substantially horizontally from the top edge of the outer collar, and a second flange portion that extends substantially perpendicular to the first flange portion from an end of the first flange portion, and wherein the coupling flange is configured to rotatably couple the light redistribution apparatus to a housing of a light fixture that houses the light module.

14. The light redistribution apparatus of claim 10, wherein an inner surface of the outer collar is reflective.

15. The light redistribution apparatus of claim 10, wherein adjacent pairs of the plurality of redirection segments are separated by a space through which the remainder portion of the light directed in the first direction passes unobstructed to illuminate an area in the first direction.

16. The light redistribution apparatus of claim 10:

wherein each redirection segment of the plurality of redirection segments is substantially rectangular shaped and comprises: two longitudinal edges disposed opposite to each other, two lateral edges that are disposed opposite to each other and between the two longitudinal edges, a first major surface, and a second major surface disposed opposite to the first major surface, and wherein each redirection segment is coupled to an inner surface of the outer collar via their respective two lateral edges.

17. The light redistribution apparatus of claim 10, wherein a height of each redirection segment of the plurality of redirection segments varies.

18. The light redistribution apparatus of claim 16, wherein at least one of the first major surface and the second major surface of each redirection segment may comprise a plurality of diffusing features to diffuse the light, wherein the diffusing features include a rippled surface.

19. A light fixture comprising:

a housing that defines a first cavity;

a light module disposed in the first cavity, wherein the light module is configured to emit light in a first direction;

a light redistribution apparatus that is disposed in the first cavity such that it receives the light from the light module, wherein the light redistribution apparatus comprises:

an outer collar that extends from a top edge toward a bottom edge and defines a second cavity, wherein a height of the outer collar measured from the top edge to the bottom edge reduces from one end of the outer collar to an opposite end thereof;

a coupling flange that extends radially outward from the top edge of the outer collar; and a plurality of redirection segments that are disposed within the outer collar and across at least a portion of the second cavity such that they redirect a portion of the light from the first direction toward a second direction while allowing a remainder portion of the light through spaces between adjacent redirection segments of the plurality of redirection segments, wherein the light redistribution apparatus is rotatably coupled to the housing.

* * * * *